US011007099B2

(12) United States Patent
Choi et al.

(10) Patent No.: US 11,007,099 B2
(45) Date of Patent: May 18, 2021

(54) MODULAR CHAIR SYSTEMS AND METHODS OF TRANSPORTING A SUBJECT WITH A MODULAR CHAIR SYSTEM

(71) Applicant: Liko Research & Development AB, Lulea (SE)

(72) Inventors: Kin Choi, Batesville, IN (US); Frederick Schultz, Bringhurst, IN (US); Mark Zerhusen, Cincinnati, OH (US)

(73) Assignee: Liko Research & Development AB, Lulea (SE)

( * ) Notice: Subject to any disclaimer, the term of this patent is extended or adjusted under 35 U.S.C. 154(b) by 255 days.

(21) Appl. No.: 16/122,218

(22) Filed: Sep. 5, 2018

(65) Prior Publication Data

US 2019/0076313 A1 Mar. 14, 2019

Related U.S. Application Data

(60) Provisional application No. 62/557,480, filed on Sep. 12, 2017.

(51) Int. Cl.
*A61G 7/10* (2006.01)
*A61G 5/10* (2006.01)
(Continued)

(52) U.S. Cl.
CPC ..... *A61G 7/1015* (2013.01); *A61G 5/1002* (2013.01); *A61G 5/1091* (2016.11);
(Continued)

(58) Field of Classification Search
CPC .. A61G 7/1015; A61G 7/1059; A61G 7/1001; A61G 7/1025; A61G 7/16;
(Continued)

(56) References Cited

U.S. PATENT DOCUMENTS 4,138,750 A * 2/1979 Michalowski ..... A61G 7/10 5/89.1
4,606,082 A * 8/1986 Kuhlman ..... A61G 5/00 280/304.1
5,056,533 A * 10/1991 Solano ..... A61G 5/1091 5/627
5,112,076 A * 5/1992 Wilson ..... A61G 5/045 180/907
(Continued)

FOREIGN PATENT DOCUMENTS

DE 10116975 A1 10/2002
JP 2000333771 A 12/2000
WO 2017085445 A1 5/2017

*Primary Examiner* — Robert G Santos
*Assistant Examiner* — Rahib T Zaman
(74) *Attorney, Agent, or Firm* — Dinsmore & Shohl LLP

(57) ABSTRACT

Modular chair systems and methods of transporting a subject using a modular chair system are described. A modular chair system includes a seat component, a chair component, and a wheelchair component. The seat component includes a seat having a planar lower surface with one or more recesses and one or more attachment bars disposed in each of the recesses. The chair component includes one or more chair latch mechanisms and the wheelchair component includes one or more wheelchair latch mechanisms. Each attachment bar corresponds to one of the chair latch mechanisms and one of the wheelchair latch mechanisms such that the seat component is configured to be placed upon the chair component or the wheelchair component and releasably held in place by the chair latch mechanisms or the wheelchair latch mechanisms.

20 Claims, 22 Drawing Sheets

(51) Int. Cl.
*A61G 7/16* (2006.01)
*A61G 5/14* (2006.01)

(52) U.S. Cl.
CPC ..... *A61G 7/1059* (2013.01); *A61G 5/104* (2013.01); *A61G 5/1035* (2013.01); *A61G 5/1067* (2013.01); *A61G 5/14* (2013.01); *A61G 7/1001* (2013.01); *A61G 7/1025* (2013.01); *A61G 7/16* (2013.01); *A61G 2200/32* (2013.01); *A61G 2200/34* (2013.01)

(58) Field of Classification Search
CPC ..... A61G 7/165; A61G 2200/32; A61G 2200/34; A61G 5/1091; A61G 5/1002; A61G 5/1035; A61G 5/104; A61G 5/1067; A61G 5/14; A61G 5/1072; A61G 5/1043; A61G 3/063; A47C 1/02; A47C 1/1024; A47C 3/16; A47C 3/18; A47C 13/00; A47C 13/005; A47C 7/0213
See application file for complete search history.

(56) References Cited

U.S. PATENT DOCUMENTS

| | | | | |
|---|---|---|---|---|
| 5,379,468 | A * | 1/1995 | Cassidy | A61G 5/045 280/304.1 |
| 5,388,289 | A * | 2/1995 | Casperson | A61G 5/00 280/250.1 |
| 5,438,722 | A | 8/1995 | Jayamanne | |
| 5,626,397 | A | 5/1997 | Reid | |
| 6,076,527 | A | 6/2000 | Rottinghaus et al. | |
| 6,430,761 | B1 | 8/2002 | Brandorff et al. | |
| 7,618,223 | B1 * | 11/2009 | Begley | A61G 7/1042 414/139.4 |
| 9,393,167 | B2 * | 7/2016 | Ganel | A61G 5/1002 |
| 2006/0213007 | A1 * | 9/2006 | Palay | A61G 7/1019 5/81.1 R |
| 2006/0236453 | A1 | 10/2006 | Jao | |
| 2009/0276955 | A1 | 11/2009 | Palay et al. | |
| 2010/0148542 | A1 | 6/2010 | Zidulka | |

* cited by examiner

MODULAR CHAIR SYSTEMS AND METHODS OF TRANSPORTING A SUBJECT WITH A MODULAR CHAIR SYSTEM

CROSS-REFERENCE TO RELATED APPLICATION

The present application claims priority to U.S. Provisional Patent Application No. 62/557,480, filed Sep. 12, 2017 and entitled "Modular Chair Systems and Methods of Transporting a Subject with a Modular Chair System," the contents of which is incorporated herein in its entirety.

BACKGROUND

Field

The present specification generally relates to devices, systems, and methods for transporting subjects and, more specifically, to modular systems for transporting a subject to a chair or wheelchair.

Technical Background

Certain bedridden subjects may have a desire or a need to move out of bed, but are unable to do so without assistance. Devices that are configured to move a subject out of bed have not been widely adopted, require a significant amount of time and effort to use, may require two or more people to move the subject, are difficult to move, difficult to set up, and difficult to store after use. In addition, such devices require the subject to be transferred more than once if the subject is moved to a chair or wheelchair.

Accordingly, a need exists for devices, systems, and methods that can move a subject from a first location, such as a bed, to another location, such as a chair, wheelchair, or the like, by requiring only a single transfer to move the subject, where such devices and systems are relatively easy to move, set up, put away, and store, and can be used by a single operator.

SUMMARY

In one embodiment, a modular chair system includes a seat component, a chair component, and a wheelchair component. The seat component includes a seat having a planar lower surface with one or more recesses and one or more attachment bars disposed within each of the one or more recesses. The chair component includes one or more chair latch mechanisms and the wheelchair component includes one or more wheelchair latch mechanisms. Each one of the one or more attachment bars corresponds to one of the one or more chair latch mechanisms and one of the one or more wheelchair latch mechanisms such that the seat component is configured to be placed upon the chair component or the wheelchair component and releasably held in place by the one or more chair latch mechanisms or the one or more wheelchair latch mechanisms.

In another embodiment, a seat component of a modular chair system includes a back, a seat coupled to the back and having a planar lower surface having one or more recesses therein, each of the one or more recesses having an attachment bar, and a plurality of cables extending from the seat and the back. The attachment bars provide a location for releasably coupling the seat component to an accessory component and the plurality of cables are configured to be releasably coupled to a lift component to suspend the seat component from the lift component.

In yet another embodiment, a seat component of a modular chair system includes a back, a lower support coupled to the back via a coupling frame, a retractable substrate disposed on the lower support, and a reel coupled to the coupling frame. The retractable substrate is at least partially wound around the reel.

In yet another embodiment, a chair component of a modular chair system includes a frame having an upper frame member and a lower frame member, the upper frame member supporting a first cross bar and the lower frame member supporting a second cross bar. The chair component further includes a plurality of latch mechanisms coupled to the first cross bar and to the second cross bar. The plurality of latch mechanisms releasably hold a plurality of corresponding attachment bars in a seat component of the modular chair system.

In yet another embodiment, a wheelchair component of a modular chair system includes a frame having an upper frame member and a lower frame member, a support plate coupled to the lower frame member, a locking turntable supported on the support plate, and a plurality of latch mechanisms coupled to the locking turntable. The plurality of latch mechanisms releasably hold a plurality of corresponding attachment bars in a seat component of the modular chair system.

In yet another embodiment, a method of transporting a subject via a modular chair system having a seat component with a plurality of attachment bars, a lift component, and an accessory component having a plurality of latch mechanisms includes positioning the seat component underneath the subject, where the subject is sitting or lying on a bed. The method further includes coupling the seat component to the lift component via a plurality of cables extending between the seat component and the lift component such that the seat component is suspended from the lift component. The method further includes transporting the lift component and the seat component to the accessory component, aligning each of the plurality of attachment bars with a corresponding one of the plurality of latch mechanisms, coupling the seat component to the accessory component by securing the plurality of attachment bars to the plurality of latch mechanisms, and disconnecting the plurality of cables from one or more of the seat component and the lift component.

Additional features and advantages of the embodiments described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
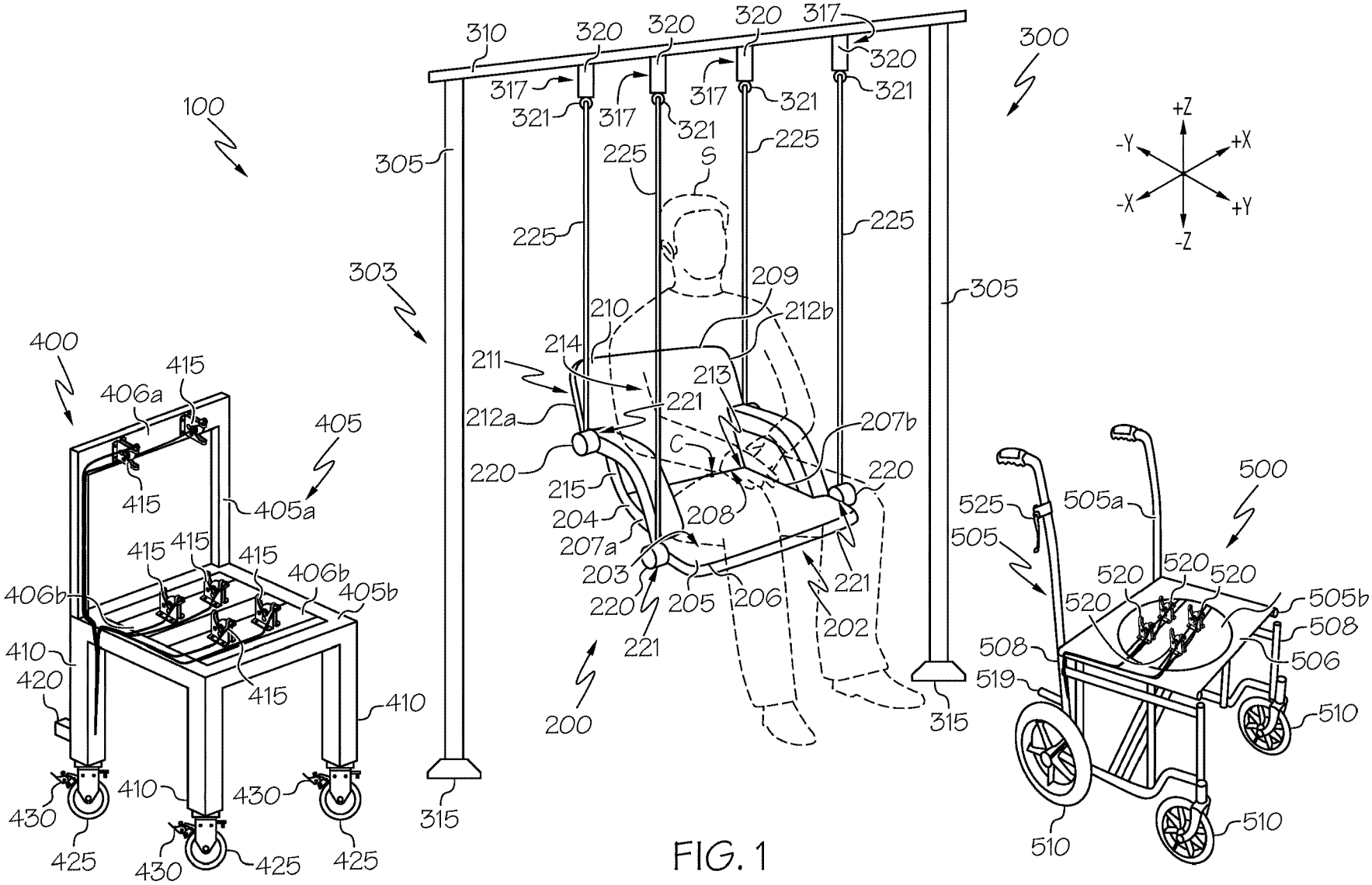
FIG. 1 schematically depicts an illustrative modular chair system according to one or more embodiments shown and described herein.

Reference will now be made in detail to embodiments of modular chair systems that include a seat component and a lift component, as well as one or more accessory components such as a chair component and a wheelchair component, examples of which are illustrated in the accompanying drawings. Whenever possible, the same reference numerals will be used throughout the drawings to refer to the same or like parts. An embodiment of a modular chair system is depicted in FIG. 1. The modular chair system generally includes a seat component that can be suspended, via a plurality of cables, from a lift component for transporting a subject seated in the seat component to a chair component or a wheelchair component. The seat component generally includes a seat having a flat underside with recesses therein, each recess having an attachment bar. The attachment bar corresponds to a latch mechanism located on the chair component and the wheelchair component such that, when the seat component is placed on top of the chair component or the wheelchair components, the latch mechanism clips onto the corresponding attachment bar to securably hold the seat component to the chair component or the wheelchair component.

The modular chair systems described herein are particularly configured such that a subject need only be transferred a single time to move between a first location, such as a bed, and a chair/wheelchair, and vice versa. That is, only an initial transfer to move the subject onto the seat component may be necessary, as the subject can then be moved to the chair component and/or the wheelchair component while remaining seated in the seat component, thereby obviating the need for an additional transfer. The seat component can be adjusted to a flat position such that the seat component can be slid underneath a subject in a supine position and subsequently adjusted to move the subject from the supine position to a sitting position. Alternatively, the seat portion of the seat component can be slid underneath a subject that is in a sitting position, such as sitting on an edge of a bed. The lack of a leg support in the seat component avoids certain situations where such a leg support would hinder the ability of the seat component to be readily slid underneath a subject (i.e., it may be difficult or impossible to slide a seat component under a subject sitting at the edge of a bed if a leg support is included). In addition, the design of the various components of the modular chair systems described herein allow for operation by a single user. That is, a single user may be able to slide the seat component under a subject, attach the seat component to the lift component, use the lift component to transport the subject to the chair component or wheelchair component, and secure the seat component to the chair component or wheelchair component, thereby effectively transferring the subject from the bed to the chair component or wheelchair component, or between the chair component and the wheelchair component.

As used herein, the term "longitudinal direction" refers to the forward-rearward direction of the person support apparatus (i.e., in the +/−X-directions of the coordinate axes depicted). The term "lateral direction" refers to the cross-direction of the person support apparatus (i.e., in the +/−Y-directions of the coordinate axes depicted), and is transverse to the longitudinal direction. The term "vertical direction" refers to the upward-downward direction of the person support apparatus (i.e., in the +/−Z-directions of the coordinate axes depicted), and is transverse to the lateral and the longitudinal directions.

Referring to FIG. 1, a modular chair system 100 is depicted. The modular chair system generally includes a seat component 200, a lift component 300, and one or more accessory components, such as, for example, a chair component 400 and a wheelchair component 500. That is, the modular chair system 100 may include only the chair component 400, only the wheelchair component 500, or both the chair component 400 and the wheelchair component 500. It should also be understood that while only the chair component 400 and the wheelchair component 500 are described and depicted herein, the modular chair system 100 may further include other accessory components without departing from the scope of the present disclosure. For example, the modular chair system 100 may include a vehicle component, a bathing component, a sofa component, and/or the like without departing from the scope of the present disclosure. A vehicle component may be a vehicle seat that is adapted to receive the seat component, the bathing component may be a shower seat that is adapted to receive the seat component, and the sofa component may be a sofa seat that is adapted to receive the seat component.

The modular chair system 100 is generally configured such that the seat component 200 is releasably attachable to the chair component 400 or the wheelchair component 500 and is movable between components via the lift component 300. That is, the seat component 200 can be secured to the chair component 400 for use as a chair or secured to the wheelchair component 500 for use as a wheelchair. It should be understood that while the seat component 200 is particularly configured to be secured to both the chair component 400 and the wheelchair component 500, the seat component 200 can only be secured to one of the chair component 400 and the wheelchair component 500 at a time.

The seat component 200 generally includes a seat 205 coupled to a back 210. The seat 205 may include a lower surface 202, an upper surface 203, and may have at least a front edge 206, a first side edge 207*a*, a second side edge 207*b*, and a rear edge 208. The seat 205 may generally be planar such that the lower surface 202 and the upper surface 203 are generally parallel to one another and respectively extend between each of the front edge 206, the first side edge 207*a*, the second side edge 207*b*, and the rear edge 208 (e.g., extending along the x-axis and the y-axis of the coordinate axes of FIG. 1). In some embodiments, the seat 205 may be constructed of a material that can be shaped, molded, contoured, or the like. For example, the seat 205, particularly the upper surface 203 thereof, may be contoured to a posterior of a subject. In another example, the upper surface 203 may be padded with a padding material. In some embodiments, the seat 205 may be constructed of a material that absorbs liquid (e.g., a wicking material), a coated material, and/or the a material that does not absorb liquids such that any liquids deposited on a surface of the seat 205 either pool on the surface thereof, drip off the surface, or pass through the material. In some embodiments, the seat 205 may support a removable and/or disposable cushion or the like.

Figure 2A:
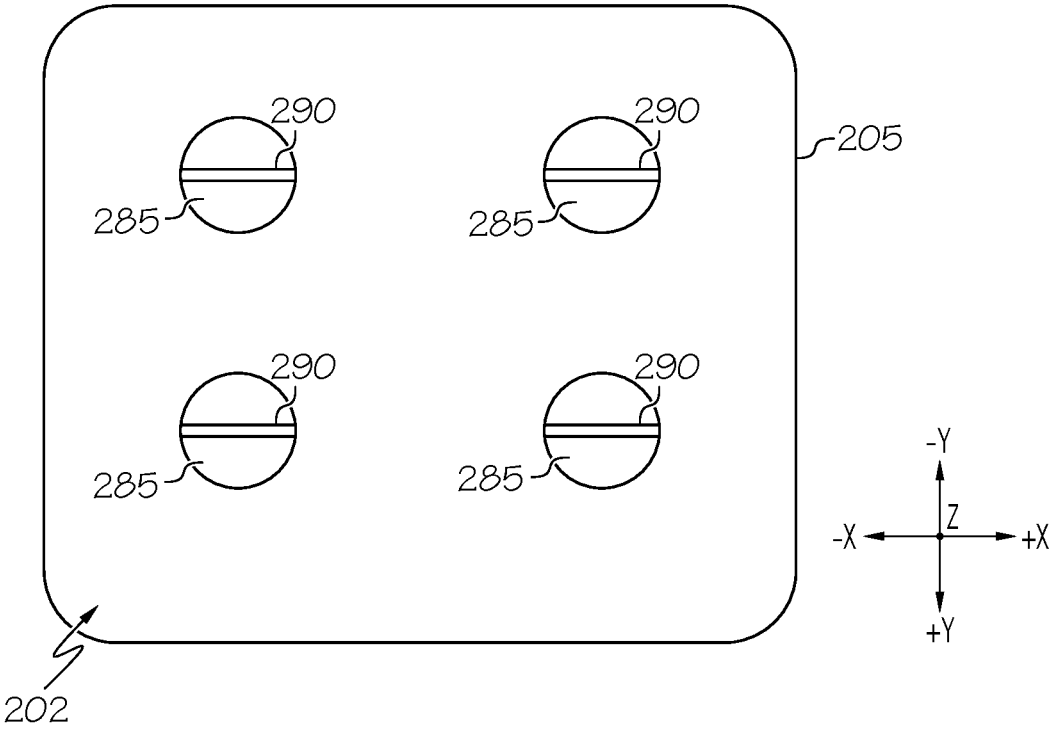
FIG. 2A schematically depicts a bottom view of an illustrative seat of a seat component of a modular chair system according to one or more embodiments shown and described herein.

Referring also to FIG. 2A, the lower surface 202 of the seat 205 is generally smooth or planar such that no protrusions extend from the lower surface 202 (i.e., extend in the −z direction of the coordinate axes of FIG. 2A). As such, the lower surface 202 is smooth for facilitating a sliding movement of the seat 205 underneath a subject, as described in greater detail herein.

The lower surface 202 of the seat 205 includes one or more recesses 285 therein, each recess containing an attachment bar 290. That is, each of the one or more recesses 285 may extend a distance from the lower surface 202 of the seat 205 toward the upper surface 203 of the seat 205. The distance is not limited by this disclosure and may be any distance, particularly a distance that allows the attachment bar 290 to be held and/or accessed within the recess 285 without protruding from the lower surface 202 of the seat 205 (i.e., protruding beyond the lower surface 202 of the seat 205 in the −z direction of the coordinate axes of FIG. 2A). For example, the recesses 285 may extend about 25% of a distance between the lower surface 202 and the upper surface 203, about 50% of the distance between the lower surface 202 and the upper surface 203, about 75% of the distance between the lower surface 202 and the upper surface 203, or the like. In some embodiments, the recess 285 may extend an entire distance between the lower surface 202 and the upper surface 203 such that the recess 285 is a bore through the seat 205. The one or more recesses 285 may generally be any size and/or shape, and may further be located at any location on the lower surface 202 of the seat 205.

The attachment bars 290 may be held in a fixed position within a corresponding recess 285 such that the attachment bars 290 do not move. That is, the attachment bars 290 are secured to the seat 205 via anchors, adhesives, screws, and/or the like to prevent movement of the attachment bars 290 with respect to the seat 205. In some embodiments, the attachment bars 290 may be integrally formed with the seat 205, such as when the attachment bars 290 are the same material as the seat 205. That is, the seat 205 may be formed by machining out material for the recess 285 around material for the attachment bar 290 or molding the seat component 200 with the recesses 285 and the attachment bars 290 formed therein.

The attachment bars 290 may be positioned within each recess 285 to provide a latching point for latching the seat component 200 to another component, such as the chair component 400 or the wheelchair component 500. For example, the attachment bars 290 may be arranged within each recess 285 such that the attachment bars 290 are substantially parallel with the lower surface 202 of the seat 205 (e.g., extending along the x axis or the y axis of the coordinate axes of FIG. 2A). In another example, the attachment bars 290 may be arranged within each recess 285 such that the attachment bars 290 are substantially transverse to the lower surface 202 of the seat 205 (e.g., extending along the z axis of the coordinate axes of FIG. 2A). The attachment bars 290 may generally be shaped and sized so as to fit within a corresponding latch mechanism and be held by the corresponding latch mechanism, as described in greater detail herein. For example, the attachment bars 290 may be cylindrical in cross-sectional shape in some embodiments. However, it should be understood that the attachment bars 290 may have alternative shapes, such as when the attachment bars 290 are formed into other shapes that provide a latching point for latching the seat component 200, such as a hook, a ring, and/or the like.

While FIG. 2A depicts four recesses 285 and a corresponding four attachment bars 290 disposed within the four recesses 285, the present disclosure is not limited to such. That is, the lower surface 202 of the seat 205 may have any number of recesses 285 and attachment bars 290. In addition, while a single attachment bar 290 is included in each recess 285, the present disclosure is not limited to such. That is, each recess 285 may include a plurality of attachment bars 290 according to some embodiments.

Referring again to FIG. 1, the back 210 may include a first major surface 211, a second major surface 214, and may have at least a top edge 209, a first side edge 212*a*, a second side edge 212*b*, and a bottom edge 213. The back 210 may generally be planar such that the first major surface 211 and the second major surface 214 are generally parallel to one another and respectively extend between each of the top edge 209, the first side edge 212*a*, the second side edge 212*b*, and the bottom edge 213 (e.g., extending along the x-axis and the z-axis of the coordinate axes of FIG. 1). In other embodiments, the back 210 may be constructed of a material that can be shaped, molded, contoured, or the like. For example, the back, particularly the second major surface 214 thereof, may be contoured to a back of a subject. In another example, the second major surface 214 may be padded with a padding material. In some embodiments, the back 210 may be constructed of an absorbing material (e.g., a wicking material), a coated material, and/or a material that does not absorb liquids such that any liquids deposited on a surface of the back 210 either pool on the surface thereof, drip off the surface, or pass through the material.

Figure 2B:
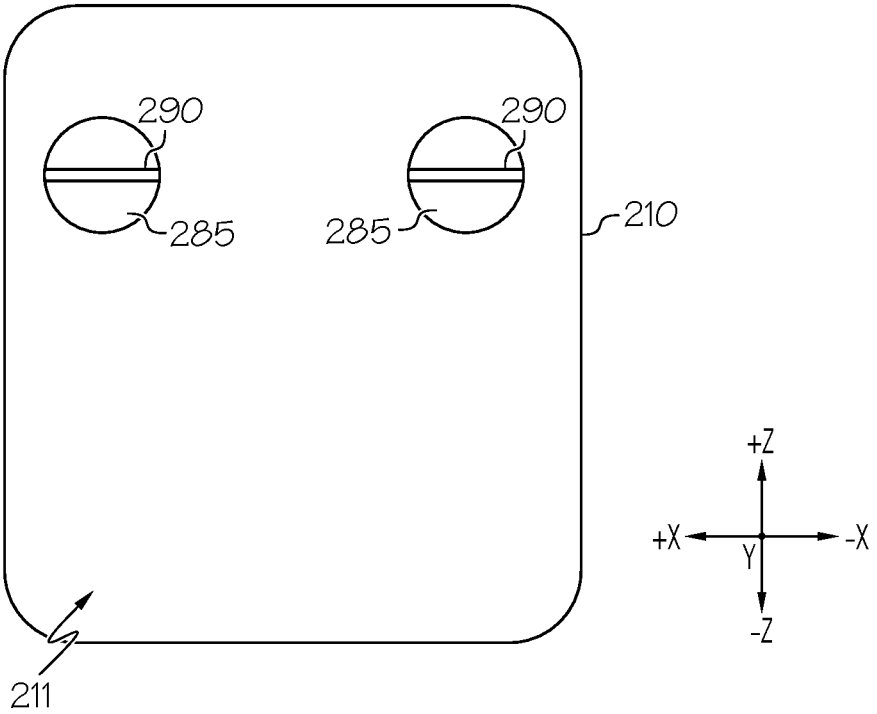
FIG. 2B schematically depicts a back view of an illustrative back of a seat component of a modular chair system according to one or more embodiments shown and described herein.

Referring also to FIG. 2B, in some embodiments, the first major surface 211 of the back 210 may generally be planar such that no protrusions extend from the first major surface 211 (i.e., extend in the +y direction of the coordinate axes of FIG. 2B). As such, the first major surface 211 may be smooth for facilitating a sliding movement of the back 210 underneath a supine subject, as described in greater detail herein.

In some embodiments, the first major surface 211 of the back 210 may include one or more recesses 285 therein, each recess containing an attachment bar 290. That is, each of the one or more recesses 285 may extend a distance from the first major surface 211 of the back 210 toward the second major surface 214 of the back 210. The distance is not limited by this disclosure and may be any distance, particularly a distance that allows the attachment bar 290 to be held and/or accessed within the recess 285. For example, the recesses 285 may extend about 25% of a distance between the first major surface 211 and the second major surface 214, about 50% of the distance between the first major surface 211 and the second major surface 214, about 75% of the distance between the first major surface 211 and the second major surface 214, or the like. In some embodiments, the recess 285 may extend an entire distance between the first major surface 211 and the second major surface 214 such that the recess 285 is a bore through the back 210. The one or more recesses 285 may generally be any size and/or shape, and may further be located at any location on the first major surface 211 of the back.

As previously described herein with respect to FIG. 2A, the attachment bars 290 may be held in a fixed position within a corresponding recess 285 such that the attachment bars 290 do not move. In addition, the attachment bars 290 may be positioned within each recess 285 such that the attachment bars 290 provide a latching point for latching the seat component 200 to another component, such as the chair component 400 or the wheelchair component 500. Also, the attachment bars 290 may generally be shaped and sized so as to fit within a corresponding latch component, as described in greater detail herein.

While FIG. 2B depicts two recesses 285 and a corresponding two attachment bars 290, the present disclosure is not limited to such. That is, the first major surface 211 of the back 210 may have any number of recesses 285 and attachment bars 290. In addition, while a single attachment bar 290 is included in each recess 285, the present disclosure is not limited to such. That is, each recess 285 may include a plurality of attachment bars 290 according to some embodiments.

In some embodiments, one or more alternative attachment mechanisms may be used in lieu of or in addition to the recesses 285 and the attachment bars 290 on the first major surface 211 of the back 210. For example, snaps, buttons, hook-and-loop fasteners, and/or the like may be used to releasably secure the back 210 to another component, such as the chair component 400 or the wheelchair component 500. In other embodiments, the back 210 may not contain any attachment mechanisms. As such, the back 210 may not be secured to an external component.

Referring again to FIG. 1, in some embodiments, the rear edge 208 of the seat 205 may be coupled to the bottom edge 213 of the back 210. That is, the rear edge 208 of the seat 205 and the bottom edge 213 of the back 210 may be directly connected to one another or may be connected via a connection device. For example, the seat 205 and the back 210 may be molded from the same single piece component, where the bottom edge 213 and the rear edge 208 represent a region of the single piece component where the back 210 and the seat 205 are joined, as described in greater detail herein. In another example, the rear edge 208 of the seat 205 may be coupled to the bottom edge 213 of the back 210 via a hinge or the like.

Figure 3A:
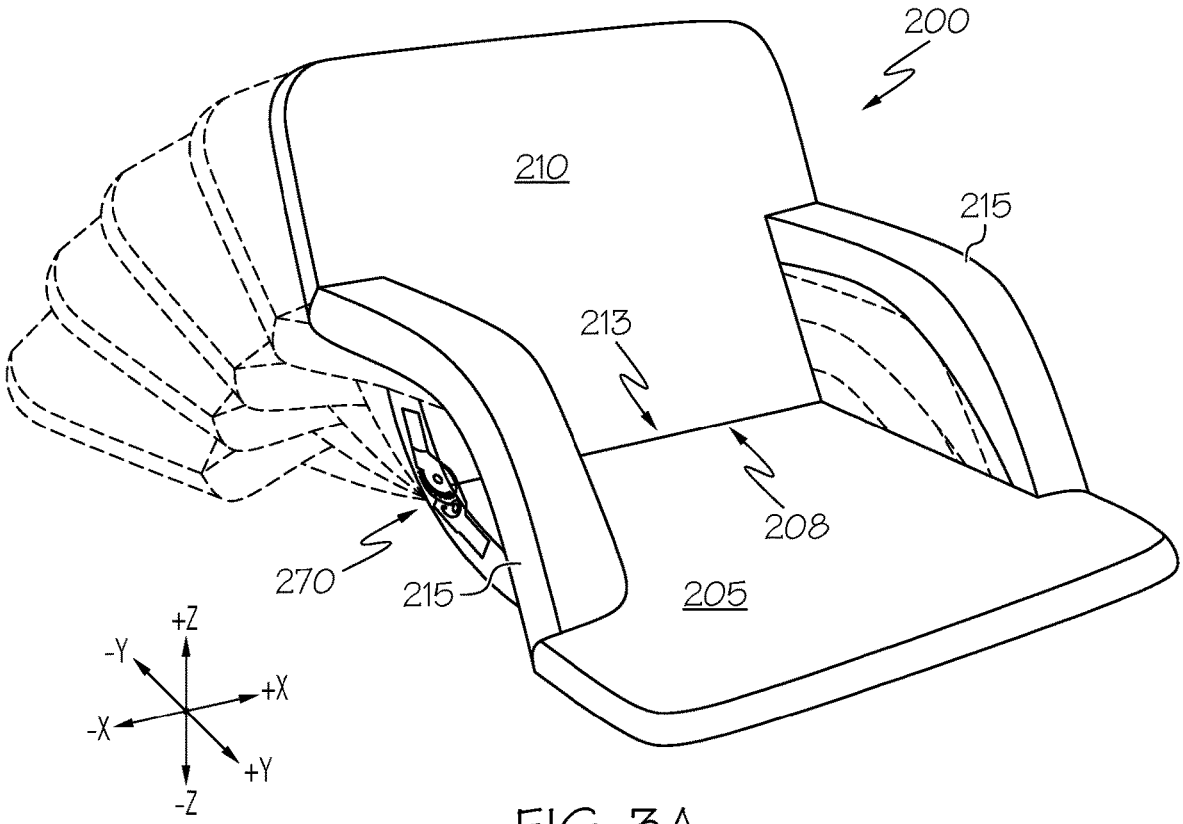
FIG. 3A schematically depicts a perspective view of an illustrative seat component of a modular chair system that has an adjustable back angle according to one or more embodiments shown and described herein.
Figure 3B:
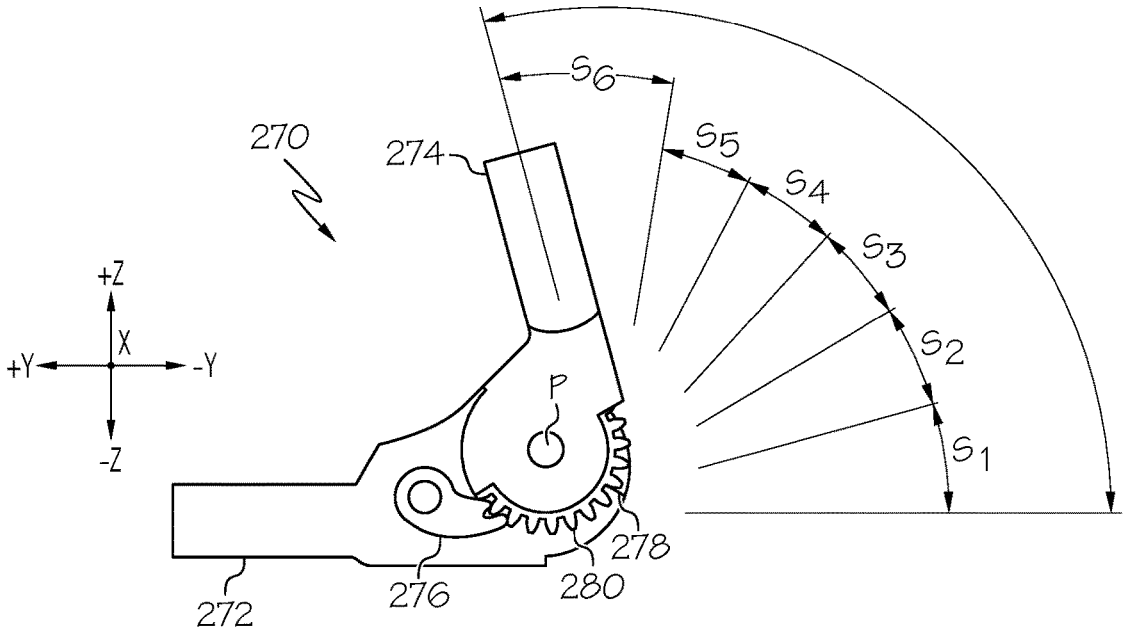
FIG. 3B schematically depicts a side view of an illustrative hinge that provides the seat component of FIG. 3A with an ability to adjust the back angle according to one or more embodiments shown and described herein.

FIGS. 3A and 3B depict certain embodiments where the rear edge 208 of the seat 205 and the bottom edge 213 of the back 210 are hingedly coupled together via one or more hinges 270 such that the seat component 200 can be reclined. Referring to FIGS. 1 and 3A-3B, an illustrative hinge 270 may generally be positioned between the seat 205 and the back 210 such that the seat 205 and the back 210 are pivotable relative to one another. The hinge 270 may include a first arm 272 pivotably coupled to a second arm 274 at a pivot point P. The first arm 272 may be coupled to the seat 205 and the second arm 274 may be coupled to the back 210. The hinge 270 may further include a ratchet member 278 coupled between the first arm 272 and the second arm 274 at the pivot point P. That is, the ratchet member 278 may surround the pivot point P between the first arm 272 and the second arm 274 and may be fixedly coupled to the first arm 272 or the second arm 274 such that the ratchet member 278 does not move relative to the arm which it is fixedly coupled. Alternatively, the ratchet member 278 may be integrated within the first arm 272 or the second arm 274 such that a pivot end of the first arm 272 or a pivot end of the second arm 274 contains the ratchet member 278. The ratchet member 278 may further include a plurality of teeth 280 positioned about a circumference of the ratchet member 278. A pawl 276 located near the pivot point P on the first arm 272 or the second arm 274 opposite the ratchet member 278 may be biased towards the ratchet member 278 such that the teeth 280 are engaged with the pawl 276, thereby preventing movement of the second arm 274 relative to the first arm 272 in a first direction (e.g., a clockwise direction), but allowing movement in a second direction (e.g., a counterclockwise direction). In addition, the biasing force on the pawl 276 may be overcome or released, such as by depressing the pawl in a downward vertical direction (e.g., in the −z direction of the coordinate axes of FIG. 3B), to temporarily allow pivot rotation of the second arm 274 relative to the first arm 272 in the first direction such that an angle between the first arm 272 and the second arm 274 can be adjusted accordingly. The teeth 280 may be spaced a distance apart from one another such that the pawl 276 catches one of the teeth 280 to stop further movement of the first arm 272 relative to the second arm 274 at a particular angle. Accordingly, the back 210 may be adjusted relative to the seat 205 at various stop points $S_1$-$S_6$ corresponding to particular angles of recline. For example, a first stop point $S_1$ may correspond to a positioning whereby the angle between the seat 205 and the back 210 is about 180° so that the seat component 200 is flat. It should be understood that the hinge 270 shown and described herein with respect to FIGS. 3A and 3B is merely illustrative, and any hinge mechanism may be used to pivot the seat 205 relative to the back 210 without departing from the scope of the present disclosure. It should also be understood that any other locking mechanism that locks a pivoting motion between the seat 205 and the back 210 at a particular location or incline/decline may also be used without departing from the scope of the present disclosure.

Figure 4A:
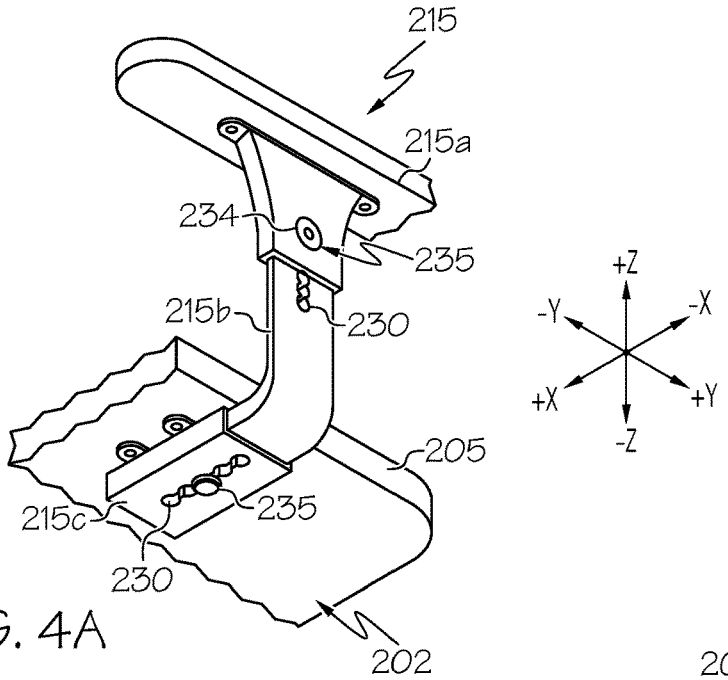
FIG. 4A schematically depicts an illustrative arm of a seat component of a modular chair system according to one or more embodiments shown and described herein.

Referring to FIGS. 1 and 4A, the seat component 200 may include one or more arms 215 in some embodiments. The arms 215 may generally be located at the sides of the seat component 200. For example, one of the arms 215 may be located at or near the first side edge 207*a* of the seat 205 and/or the first side edge 212*a* of the back 210. In another example, one of the arms 215 may be located at or near the second side edge 207*b* of the seat 205 and/or the second side edge 212*b* of the back 210.

The arms 215 may be coupled to the seat 205 and/or the back 210. For example, in embodiments where the seat component 200 can recline, the arms 215 may only be coupled to the seat 205 or the back 210 so as to avoid hindering the pivoting movement of the seat 205 and back 210 relative to one another. In another example, the arms 215 may be coupled to both the seat 205 and the back 210.

Figure 4B:
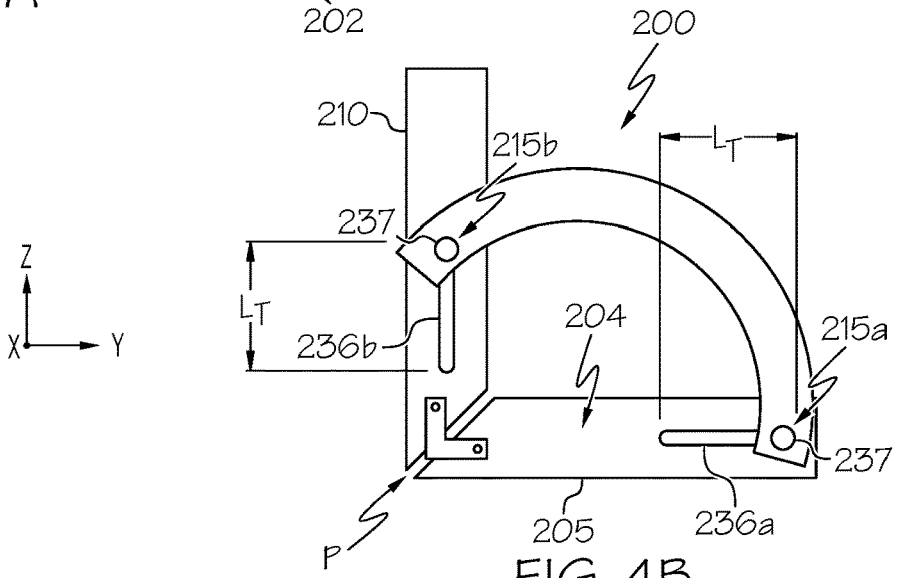
FIG. 4B schematically depicts a side view of an illustrative seat component having an adjustable arm according to one or more embodiments shown and described herein.

The arms 215 may generally be coupled to any portion of the seat 205 and/or back 210. For example, as shown in FIG. 4A, the arms 215 may be coupled to the lower surface 202 of the seat. In another example, as shown in FIG. 4B, the arms 215 may be coupled to a side 204 of the seat 205 and a side 216 of the back 210. The arms may generally be coupled to the seat 205 and/or the back 210 via any coupling mechanism. For example, the arms 215 may be coupled via one or more pins, screws, bolts, and/or the like.

In some embodiments, the arms 215 may be adjustable. For example, as shown in FIG. 4A, the arms 215 may be adjusted for height (i.e., adjustable by moving the arm 215 generally along the +z/−z axis of the coordinate axes of FIG. 4A) and/or may be adjusted for depth (i.e., adjustable by moving the arm 215 generally along the +x/−x axis of the coordinate axes of FIG. 4A). That is, in some embodiments, the arms 215 may be adjustable for height and/or depth by slidably moving a plurality of nested arm portions 215*a*, 215*b*, 215*c* with respect to one another and locking the nested arm portions 215*a*, 215*b*, 215*c* in place at a particular height. For example, a first nested arm portion 215*a* may have a bore 234 therethrough for accepting a pin 235, such as a pin portion of a pin and clevis fastener, a spring loaded pin, or the like. In addition, a second nested arm portion 215*b* that is nested inside the first nested arm portion 215*a* may include an adjustment cavity, such as a slot, bore, or the like that receives the pin 235 when the pin 235 is inserted through the bore 234 of the first nested arm portion 215*a* surrounding the second nested arm portion 215*b*. The pin 235 may be locked in place to hold the first nested arm portion 215*a* and the second nested arm portion 215*b* together in a fixed position.

Figure 4C:
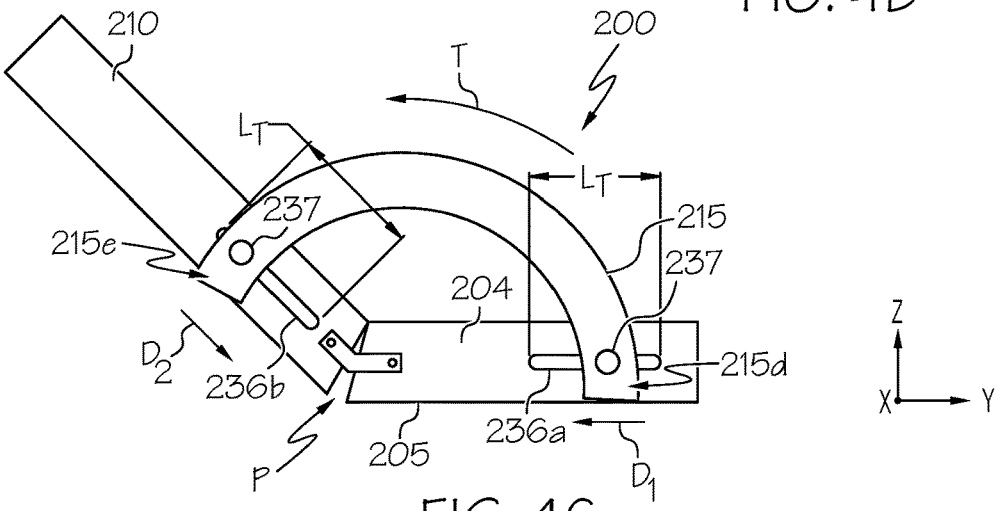
FIG. 4C schematically depicts a side view of movement of an illustrative seat component having an adjustable arm according to one or more embodiments shown and described herein.

Referring now to FIGS. 4B-4C, in some embodiments, the arms 215 may be adjustable such as when the arms 215 slide along tracks 236 located on the side 204 of the seat 205 and the side 216 of the back 210. That is, the seat component 200 may further include a first track 236*a* coupled to and positioned lengthwise along the side 204 of the seat 205 and a second track 236*b* coupled to and positioned lengthwise along the side 216 of the back 210. A first end 215*d* of the arm 215 is coupled to the first track 236*a* positioned on the side 204 of the seat 205 via a guide pin 237. That is, the guide pin 237 extends through the first end 215*d* of the arm 215 and into the first track 236*a* and acts as a pivot point, allowing the arm 215 to pivot about the guide pin 237 and allowing the arm 215 to slide along a length $L_T$ of the first track 236*a* (and therefore along at least a portion of a length of the side 204 of the seat 205). In addition, the guide pin 237 may also have a locking mechanism (e.g., a push button positive lock or the like) that allows the guide pin 237 to lock the first end 215*d* of the arm 215 in a fixed position along the length $L_T$ of the first track 236*a* such that the arm 215 does not continue to move along the length $L_T$ of the first track 236*a*. Similarly, a second end 215*e* of the arm 215 is coupled to a second track 236*b* positioned on the side 216 of the back 210 via a guide pin 237. That is, the guide pin 237 extends through the second end 215*e* of the arm 215 and into the second track 236*b* and acts as a pivot point, allowing the arm 215 to pivot about the guide pin 237 and allowing the arm 215 to slide along a length $L_T$ of the second track 236*b* (and therefore along at least a portion of a length of the side 216 of the back 210). In addition, the guide pin 237 may also have a locking mechanism (e.g., a push button positive lock or the like) that allows the guide pin 237 to lock the second end 215*e* of the arm 215 in a fixed position along the length $L_T$ of the second track 236*b* such that the arm 215 cannot move along the length $L_T$ of the second track 236*b*.

The tracks 236 may generally be used to adjust the arms 215 in embodiments where the back 210 and the seat 205 pivot relative to one another. That is, the arms 215 may be adjustable via the tracks 236 such that the arms 215 do not hinder pivot movement of the back 210 and/or the seat 205. As shown in FIG. 4B, when the seat component 200 is in a generally upright position (i.e., generally about a 90° angle formed by the intersection of the seat 205 and the back 210), the arms 215 may be locked via the guide pins 237 in a first position on the tracks 236. To recline the seat component 200 as shown in FIG. 4C (e.g., to move the back 210 in direction T), the guide pins 237 may be unlocked to allow the arms 215 to slide along the tracks 236. For example, the first end 215*d* of the arm 215 coupled to the first track 236*a* located on the seat 205 may slide in a first direction $D_1$ while the second end 215*e* of the arm 215 coupled to the second track 236*b* located on the back 210 may slide in a second direction $D_2$. Both the first direction $D_1$ and the second direction $D_2$ may generally be towards the pivot point P of the seat component 200 between the seat 205 and the back 210. Once the seat component 200 is reclined to a particular position, the locking mechanism on the guide pins 237 may be locked to avoid further movement of the arms 215 relative to the tracks 216.

Referring again to FIG. 1, a plurality of cables 225 may extend between the seat component 200 and the lift component 300. That is, each of the cables 225 may extend between an attachment point on the seat component 200 and an attachment point on the lift component 300. Each of the attachment points on the seat component 200 may be located at one of a plurality of attachment locations 221 on the seat component 200. The attachment locations 221 are not limited by this disclosure and may generally be at any location on the seat component 200, including any location on the seat 205, any location on the back 210, and/or any location on the arms 215. In some embodiments, the attachment locations 221 may be at one or more positions that allow the seat component 200 to be suspended such that the center of gravity of the seat component 200 is located at an area on the seat component 200 that will not result in the seat component 200 tipping over when a subject S is seated in the seat component 200. For example, the attachment locations 221 may be located such that the center of gravity of the seat component 200 is generally at or adjacent to a center point C located where the rear edge 208 of the seat 205 meets the bottom edge 213 of the back 210 at about a midpoint location between the first side edge 207*a* and the second side edge 207*b* of the seat 205 and/or at about a midpoint location between the first side edge 212*a* and the second side edge 212*b* of the back 210. It should be understood that the center of gravity of the seat component 200 may vary depending on whether a cable 225 is supporting the seat component 200 at a particular attachment location 221, the number of cables 225 supporting the seat component 200, the relative lengths of the cables 225, and/or the like. For example, if a particular attachment location 221 is not in use (i.e., no cable 225 supporting the seat component 200 at that location), the center of gravity may be shifted to a location that corresponds to other attachment locations 221 that do have a cable 225 supporting the seat component 200.

The cables 225 are generally not limited by the present disclosure in shape, size, design, or materials. In some embodiments, the cables 225 may extend a particular length such that, when coupled between the seat component 200 and the lift component 300, the seat component 200 is suspended from the lift component 300 (i.e., the seat component 200 is not supported on the bottom by the floor). As a result, objects can be moved underneath the seat component 200 (e.g., a bed, an accessory component such as the chair component 400 or the wheelchair component 500, or the like).

In some embodiments, the cables 225 may be constructed of a material that exhibits strength properties such that the cables 225 can support the weight of the seat component 200 and a subject S sitting in the seat component 200 when the cables 225 are coupled between the seat component 200 and the lift component 300. In some embodiments, each of the cables 225 may be constructed of a material exhibiting elastic properties such that each of the cables 225 can stretch. In some embodiments, each of the cables 225 may be constructed of a flexible material such that the cables 225 can be wound, bundled, and/or the like. Illustrative examples of materials that may be used for the cables include, but are not limited to, steel wire, woven nylon, woven fabric (e.g., polypropylene, polyester, etc.), plastic, leather, rubber, carbon fiber, or the like, as well as combinations thereof.

Figure 5A:
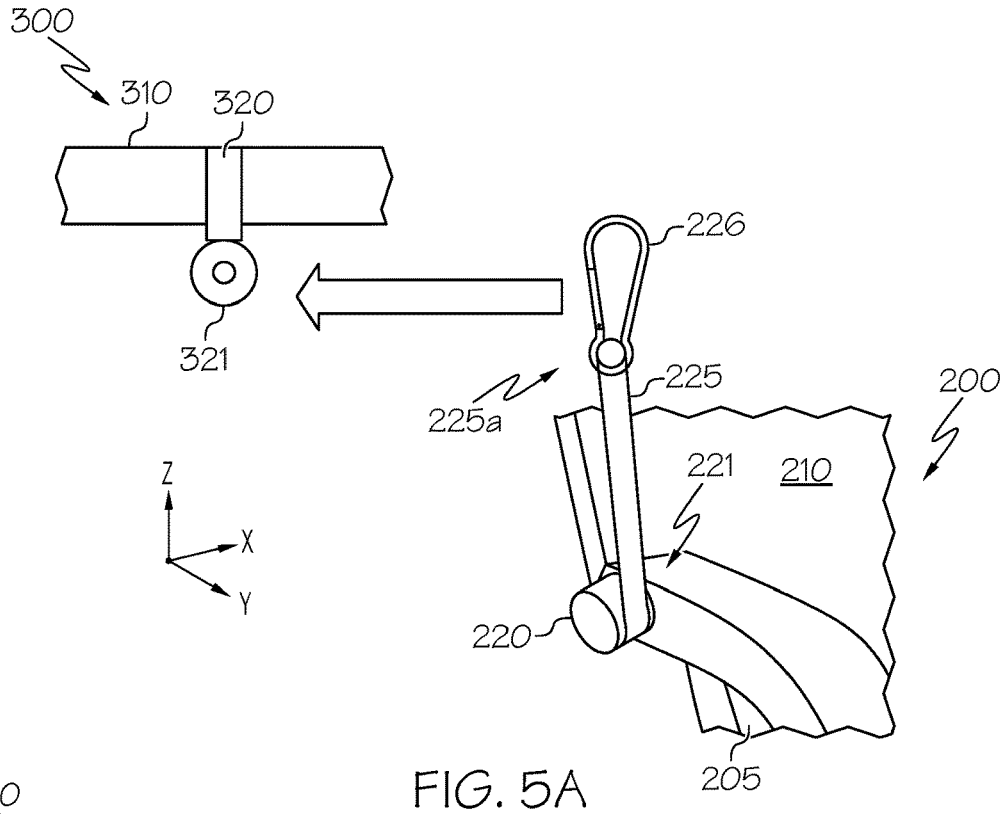
FIG. 5A schematically depicts an illustrative coupling of a seat component to a lift component of a modular chair system according to one or more embodiments shown and described herein.

The length of the cables 225 may be adjustable to move the seat component 200 up and down along the vertical axis (i.e., in the +z/−z direction of the coordinate axes of FIG. 1). For example, each one of the cables 225 may be retractable into a locking retraction mechanism 220 that holds the cable 225 in a retracted state when not in use (i.e., when not extending between the seat component 200 and the lift component 300), extended from the locking retraction mechanism 220, and/or held at a particular location by the locking retraction mechanism 220. As such, the cable 225 may be adjusted for length by extending or retracting the cable 225 into/from the locking retraction mechanism 220. In addition, the locking retraction mechanism 220 may act as an attachment point on the seat component 200 and/or the lift component 300. For example, as shown in FIGS. 1 and 5A, a locking retraction mechanism 220 may be located at each of a plurality of attachment locations 221 on the seat component 200. In another example, as shown in FIG. 5B, an alternative locking retraction mechanism 220' may be located at an attachment location 221 on an upper support bar 310 of the lift component 300.

Referring to FIGS. 1 and 5A, each cable 225 may extend from a corresponding locking retraction mechanism 220 on the seat component 200. A distal end 225*a* of the cable 225 may include a coupling device 226 that is used to attach the distal end 225*a* of the cable 225 to an attachment ring 321 located on the upper support bar 310 of the lift component 300. The coupling device 226 is not limited by this disclosure and may generally be any device that allows for releasably coupling the cable 225. For example, as shown in FIG. 5A, the distal end 225*a* of the cable may be coupled to a carabiner or the like that contains a spring loaded gate that provides the ability to releasably couple the strap to the attachment ring 321 such that the cable 225 extends between the seat component 200 and the lift component 300.

Figure 5B:
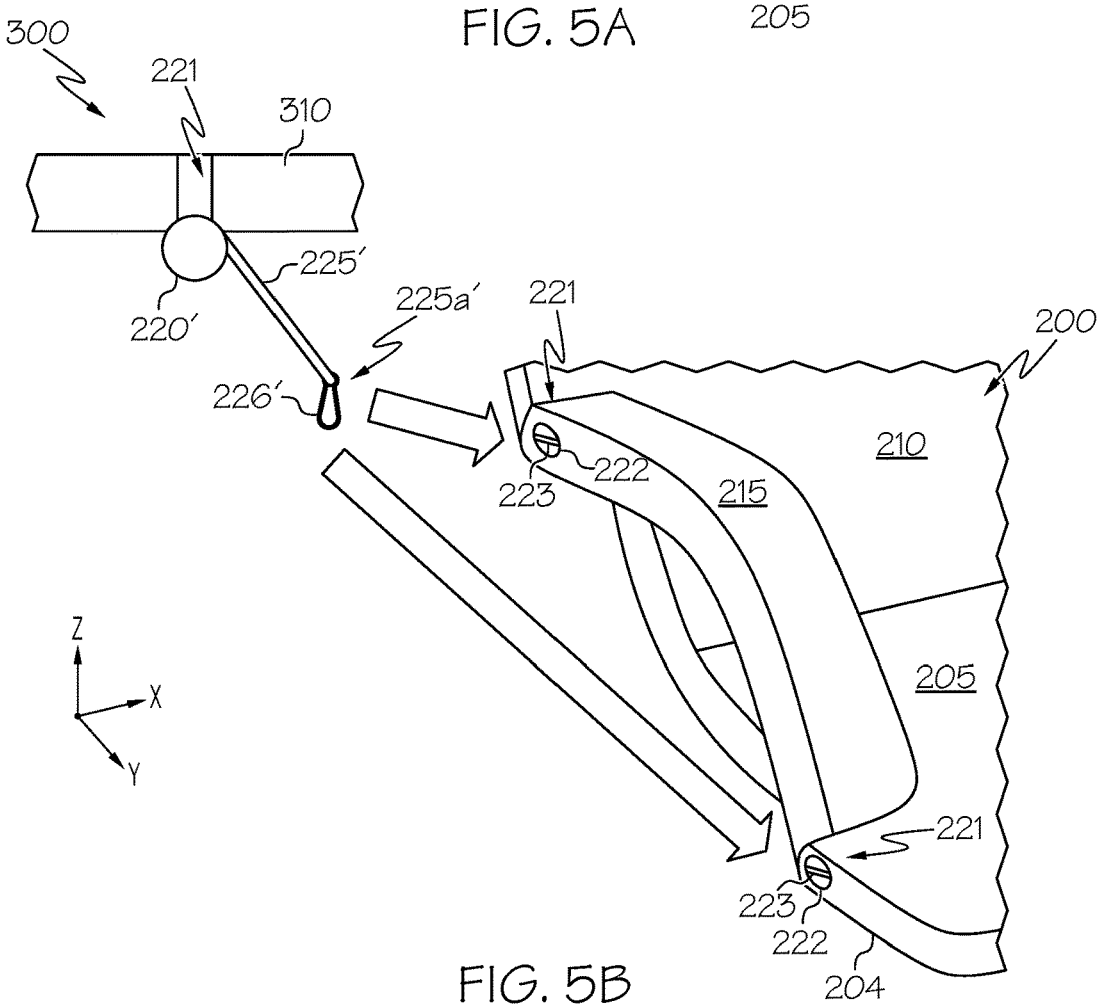
FIG. 5B schematically depicts another illustrative coupling of a seat component to a lift component of a modular chair system according to one or more embodiments shown and described herein.

Alternatively, referring to FIGS. 1 and 5B, each cable 225' may extend from a corresponding locking retraction mechanism 220' located on the upper support bar 310 of the lift component 300. A distal end 225*a'* of the cable 225' may include a coupling device 226' that is used to attach the distal end 225*a'* of the cable 225' to an attachment bar 223 on the chair component 200. The coupling device 226' is likewise not limited by this disclosure and may generally be any device that allows for releasably coupling the cable 225', such as a carabiner or the like. The attachment bar 223 may generally be a device that is anchored to a portion of the seat component 200 at an attachment location 221 such that the attachment bar 223 can support the weight of the seat component 200 and/or a subject S sitting in the seat component 200 when the cable 225' is coupled thereto and the seat component 200 is suspended from the lift component 300. The attachment bar 223 may be anchored within a surface of the seat component 200, such as, for example, anchored within the side 204 of the seat 205. In some embodiments, the attachment bar 223 may extend from a surface in which it is anchored. In other embodiments, the attachment bar 223 may be located within a recess 222 such that the attachment bar 223 does not extend from the surface in which it is anchored. It should be understood that the attachment bar 223 is only one illustrative example of a device that is used as an attachment point for the coupling device 226' and other devices may also be used without departing from the scope of the present disclosure.

Figure 6A:
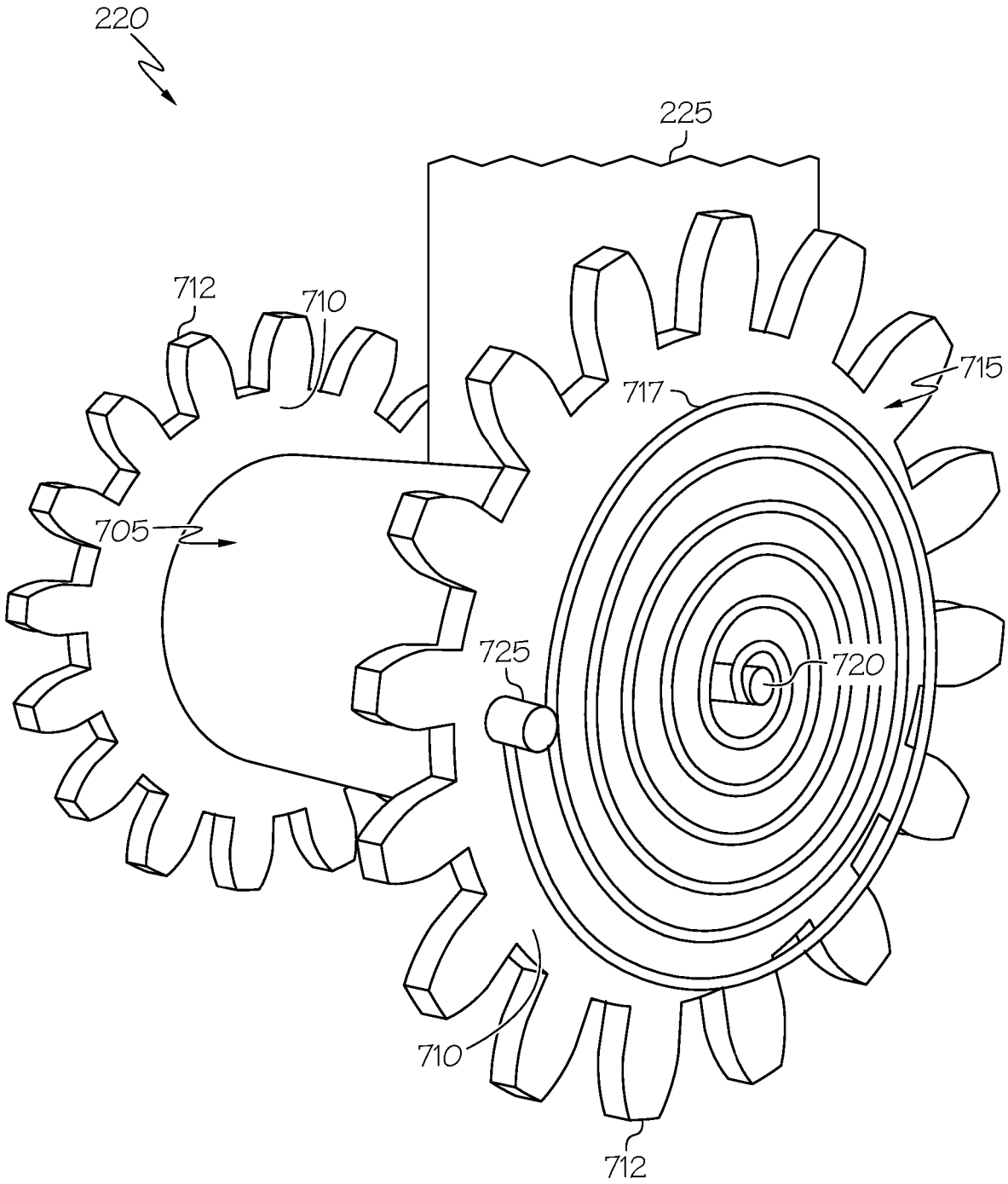
FIG. 6A schematically depicts a plurality of internal components of an illustrative locking retraction mechanism according to one or more embodiments shown and described herein.
Figure 6C:
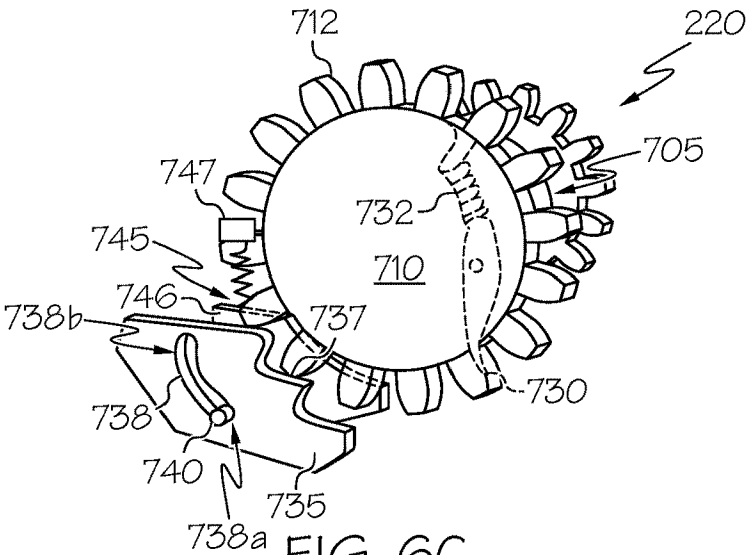
FIG. 6C schematically depicts an illustrative retraction system having an extended centrifugal clutch according to one or more embodiments shown and described herein.
Figure 6B:
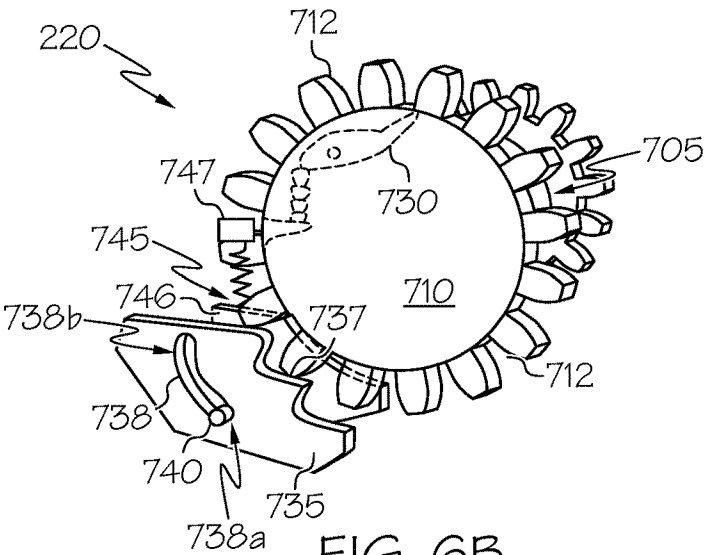
FIG. 6B schematically depicts an illustrative locking retraction mechanism in a free movement configuration according to one or more embodiments shown and described herein.
Figure 6D:
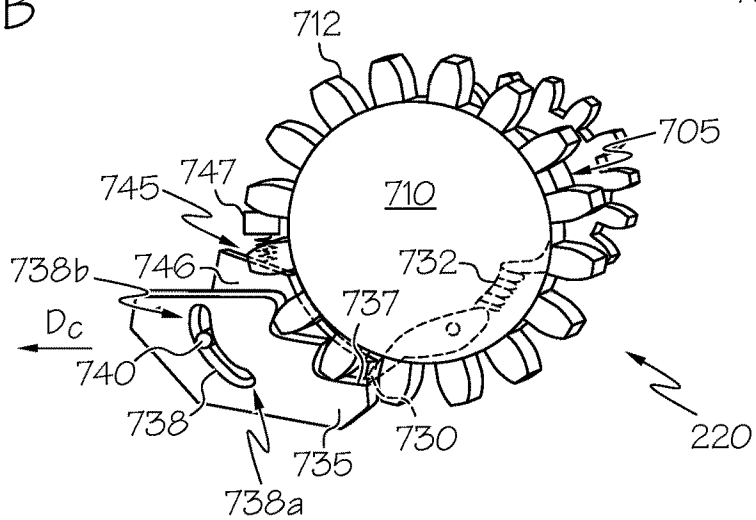
FIG. 6D schematically depicts an illustrative retraction system in a locked configuration according to one or more embodiments shown and described herein.

Referring now to FIGS. 1 and 6A-6D, the locking retraction mechanism 220 may generally include a central shaft 705 coupled to one or more gears 710. The central shaft 705 may generally be a cylindrical shaped shaft having a gear 710 coupled to one or both ends thereof. The cable 225 may be wound around the central shaft 705 such that a rotary movement of the central shaft 705 causes the cable 225 to coil around or uncoil from the central shaft 705, thereby extending or retracting the cable 225 (and adjusting the length of the cable 225 between the seat component 200 and the lift component 300). For example, as shown in FIG. 6A, the cable 225 is wound around the central shaft 705 such that a counterclockwise rotation of the central shaft 705 causes the cable 225 to unwind from the central shaft 705 (i.e., extend out of the locking retraction mechanism 220) and a clockwise rotation of the central shaft 705 causes the cable 225 to wind into the central shaft 705 (i.e., retract into the locking retraction mechanism 220). In some embodiments, one or more of the gears 710 may be coupled to or integrated with a biasing assembly 715 that biases the gear 710 in a particular direction (e.g., in a clockwise direction). The biasing assembly 715 may include, for example, a spring 717 coupled to an inner post 720 and an outer post 725. The inner post 720 may be located at a center of the gear 710 and may be rigidly arranged such that the gear 710 rotates around the inner post 720 while the inner post 720 remains in a fixed position. In addition, the outer post 725 may be located at a distal location from the inner post 720 and may be coupled to the gear 710 such that it moves with the gear 710 when the gear 710 rotates around the inner post 720. The spring 717 may be wound around the inner post 720 such that the spring 717 is compressed when the gear 710 and outer post 725 thereon are rotated in a first direction (e.g., in a clockwise direction) and expanded when the gear 710 and the outer post 725 thereon are rotated in a second direction opposite the first direction (e.g., in a counterclockwise direction). As such, the spring 717 causes the biasing assembly 715 to bias in the first direction, which causes the gear 710 and the central shaft 705 attached thereto to move in the first direction to wrap the cable 225 around the central shaft 705 such that there is no slack in the cable 225.

Still referring to FIGS. 1 and 6A-6D, the locking retraction mechanism 220 may also have a locking mechanism that stops the central shaft 705 from rotating when the cable 225 is extended a particular length from the locking retraction mechanism 220. That is, when an external tensioning force is supplied to the cable 225 (e.g., a sharp extending force is applied to the cable 225), such a tensioning force may increase a rotational speed of the central shaft 705 beyond a threshold speed, which results in an activation of the locking mechanism that temporarily locks the central shaft 705 in place and prevents further movement in the first direction until the locking mechanism is released by retracting the cable 225, thereby rotating the central shaft 705 in the second direction. More specifically, the locking retraction mechanism 220 includes a centrifugal clutch with a cam piece 746 having a pin 740 extending therefrom and slidably positioned within a track 738 of a pawl 735 that is arranged adjacent to the cam piece 746. The cam piece 746 is further biased by a biasing assembly 745 attached between the cam piece 746 and a fixed component 747 such that the pin 740 is located at a first end 738*a* of the track 738. The centrifugal clutch is generally a weighted pivoting lever 730 pivotally mounted to the rotating gear 710. When the central shaft 705 and the gear 710 spin slowly (i.e., lower than the speed threshold), the lever 730 does not pivot, but rather remains in place by a spring 732 that biases the lever in a retracted position. When the tensioning force applied to the cable 225 causes the central shaft 705 and the gear 710 to rotate at a speed above the threshold, a centrifugal force overcomes the biasing force of the spring 732 and drives a weighted end of the lever 730 outward (i.e., in a distal direction). The extended lever 730 contacts the cam piece 746 and pushes the cam piece 746. As the cam piece 746 moves to the left (i.e., generally in a cam direction $D_C$) as a result of being pushed by the extended lever 730, the pin 740 moves within the track 738 of the pawl 735 towards the second end 738*b* of the track. Movement of the pin 740 to the second end 738*b* of the track 738 causes the pawl 735 to move into a position such that teeth 737 on the pawl 735 contact teeth 712 of the gear 710. As a result, the pawl 735 locks the gear 710 in a fixed position, thus preventing counter-clockwise rotation of the gear 710 and the central shaft 705. When the gear 710 and the central shaft 705 are rotated in the clockwise direction, the lever 730 is biased by the spring 732 back to a retracted state whereby the lever 730 no longer contacts the cam piece 746. As a result, the biasing assembly 745 biases the cam piece 746 such that the pin 740 moves back to the first end 738*a* of the track 738, which causes the pawl 735 to move away from the engagement with the gear 710 such that the gear 710 and the central shaft 705 are able to freely rotate again.

The above-described functionality of the locking retraction mechanism 220 may generally be used to extend the cable 225 to a desired length and, thereafter, application of a sharp, quick force on the strap may be used to cause the locking retraction mechanism 220 to lock the cable 225 at the desired length and hold the strap at the desired length for suspending the seat component 200 from the lift component 300. It should be understood that this embodiment of the the locking retraction mechanism 220 is merely an illustrative example of a device that can be used to extend the length of each of the cables 225 to a desired length. Other devices and/or mechanisms may also be used, such as straps that are incorporated with slides, loops, reducing loops, clasps, buckles, and/or the like. Yet other devices and/or mechanisms that may be used to extend the length of each of the cables 225 to a desired length may include electronically controlled winches and/or the like.

Figure 7:
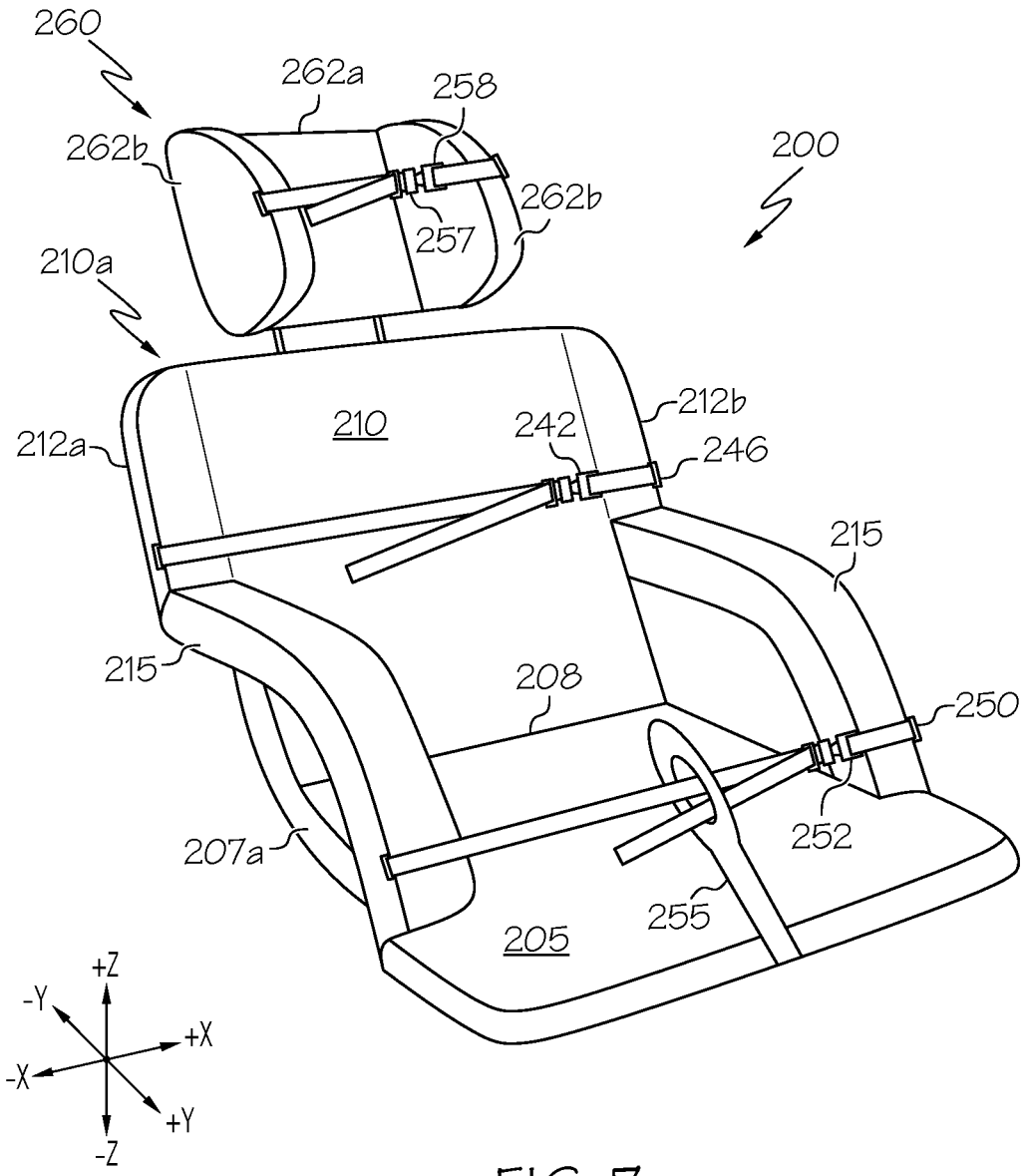
FIG. 7 schematically depicts a perspective view of an illustrative seat component of a modular chair system having a plurality of securing straps according to one or more embodiments shown and described herein.

Referring now to FIGS. 1 and 7, in some embodiments, the seat component 200 may incorporate one or more body retention devices to hold the subject S in the seat component 200, particularly when the seat component 200 is suspended by the lift component 300, supported on the chair component 400, and/or supported on the wheelchair component 500. Illustrative examples of body retention devices include, but are not limited to a head support 260 and one or more retention straps, such as, for example, an upper strap 246, a lower strap 250, a crotch loop 255, and/or a head strap 258.

The head support 260 may be a headrest or the like that is coupled to the seat component 200 in a location that corresponds to where a subject's head would be located when sitting in the seat component 200. For example, the head support 260 may be coupled to a top 210*a* of the back 210. The head support 260 may be coupled to the seat component 200 by any means of attachment. For example, the head support 260 may be integrated within the back 210 such that the head support 260 extends from the top 210*a* of the back 210. In another embodiment, the head support 260 may contain one or more posts that are receivably held within a corresponding receptacle located in the back 210. Such a configuration may allow the head support 260 to be removed or to be height adjustable. In some embodiments, the head support 260 may include a back 262*a* and one or more wings 262*b* coupled to the back 262*a*. The back 262*a* may generally be positioned such that it is parallel with or coplanar to the back 210 of the seat component 200. The one or more wings 262*b* may be positioned such that the wings 262*b* form an angle with the back 262*a*. In some embodiments, the wings 262*b* may be coplanar with the back 262*a*. In other embodiments, the wings 262*b* may form an acute angle with the back 262*a*. In some embodiments, the wings 262*b* may be adjustable such that the angle formed between the wings 262*b* and the back 262*a* can be changed. For example, a hinge, such as a locking piano hinge or the like, may be mounted between the back 262*a* and the wings 262*b* such that the wings 262*b* are pivotable about the hinge. It should be understood that the wings 262*b* may be adjusted to hold a subject's head in a particular position or location such that the subject's head is supported on the head support 260.

The various retention straps, including the upper strap 246, the lower strap 250, the crotch loop 255, and/or the head strap 258 may generally be positioned at any location on the seat component 200 and/or the head support 260. For example, the upper strap 246 may be positioned to extend across a length of the back 210 (e.g., extend from the first side edge 212*a* to the second side edge 212*b* of the back 210). In another example, the lower strap 250 may be positioned to extend across a length of the seat 205 (e.g., extend from the first side edge 207*a* to the second side edge 207*b* of the seat 205). In yet another example, the head strap 258 may be positioned to extend across a length of the head support 260 (e.g., extend from a first one of the wings 262*b* to a second one of the wings 262*b*). In yet another example, the crotch loop 255 may be positioned to extend from the front edge 206 of the seat 205. In some embodiments, the various retention straps may be particularly positioned to generally correspond to a particular area of a subject's body to restrain and/or be particularly positioned so as to not cause discomfort to the subject. For example, the upper strap 246 may be positioned to secure a subject's torso, the lower strap 250 may be positioned to secure a subject's hips, and the head strap 258 may be positioned to secure a subject's head. In another example, the crotch loop 255 may be positioned between a subject's legs and further configured such that the lower strap 250 passes through the crotch loop 255 to secure the subject's legs and hips to prevent the subject from sliding with respect to the seat component 200. In some embodiments, one or more of the retention straps may be retractable into a retraction mechanism (not shown) such as the lockable retraction mechanism described herein. In other embodiments, one or more of the retention straps may be adjustable for length, such as by incorporating one or more slides, loops, reducing loops, clasps, buckles, and/or the like. In some embodiments, the upper strap 246, the lower strap 250, and the head strap 258 may each have two portions, where each portion is coupled to the other portion via a buckle or the like. That is, the upper strap 246 may include a first strap portion and a second strap portion joined together by an upper buckle 242, the lower strap 250 may include a first strap portion and a second strap portion joined together by a lower buckle 252, and the head strap 258 may include a first strap portion and a second strap portion joined together by a head buckle 257.

Figure 8A:
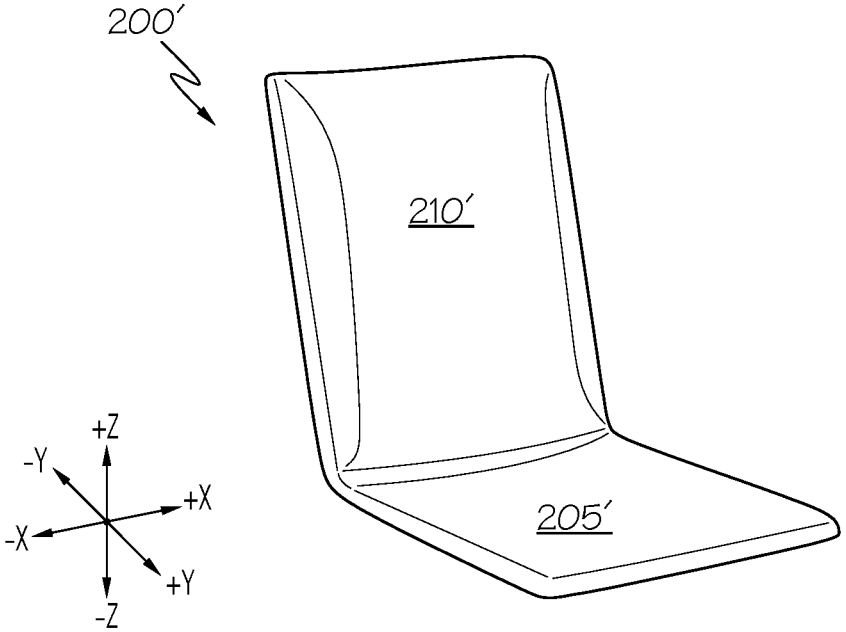
FIG. 8A schematically depicts an illustrative seat component of a modular chair system having a single piece construction according to one or more embodiments shown and described herein.

In some embodiments, the seat component 200 may be a single piece component. That is, as shown in FIG. 8A, a seat component 200' may not contain separate back and seat portions that are joined together as previously described herein, but may rather be a one piece construction having a seat region 205' and a back region 210'. The seat component 200' may be constructed of a moldable material, such as a thermoplastic resin or the like that is injection molded to form the seat component having the seat region 205' and the back region 210'. It should be understood that such a seat component 200' may not have an adjustable back as previously described herein.

Figure 8B:
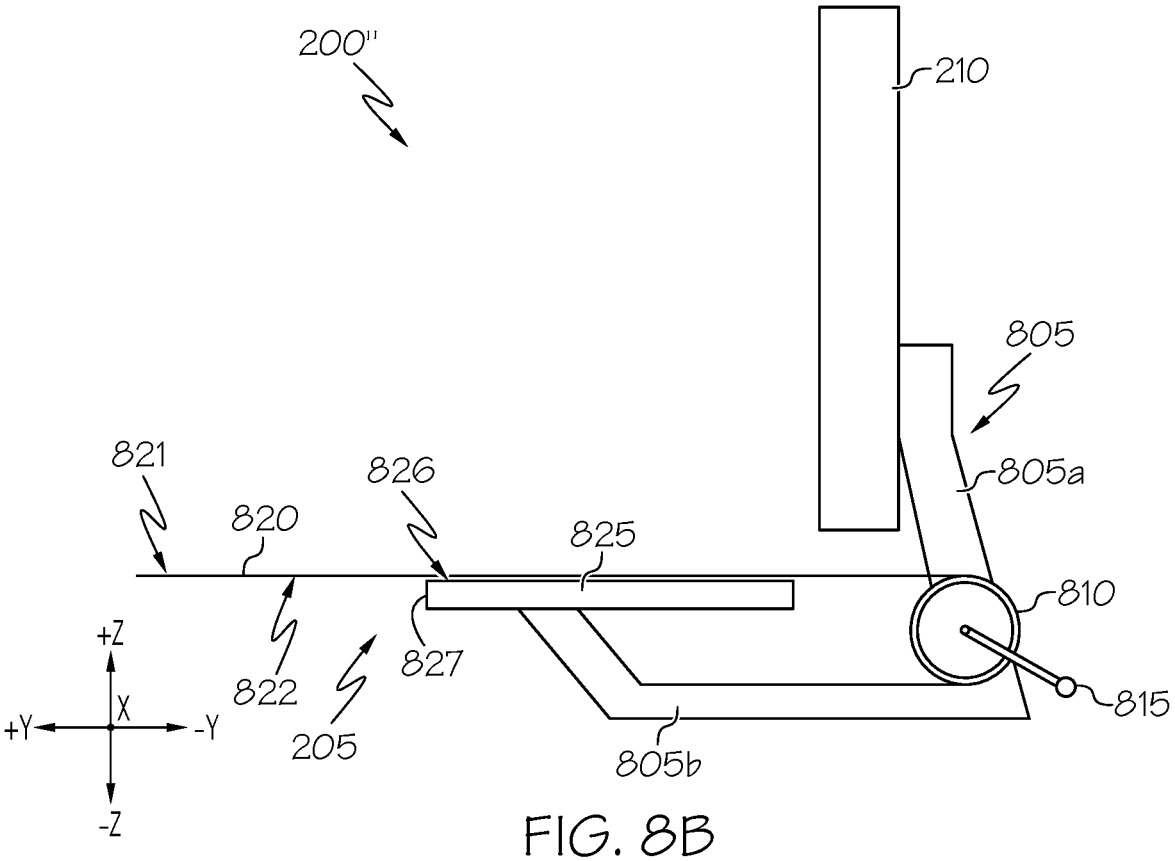
FIG. 8B schematically depicts an illustrative seat component of a modular chair system having a two piece construction and a crank operated seat retraction and extension mechanism according to one or more embodiments shown and described herein.

Referring now to FIG. 8B, in some embodiments, a seat component 200" may include the back 210 coupled to a lower support 825 via a coupling frame 805. The lower support 825 may function as a seat such that the lower support 825 is positioned generally transverse to the back 210. The coupling frame 805 may include a first portion 805*a* and a second portion 805*b*, whereby the first portion 805*a* is coupled to the back 210 and the second portion 805*b* is coupled to the lower support 825. As such, the coupling frame 805 may have an angled or curved configuration as shown in FIG. 8B. The seat component 200" may also include a retractable substrate 820 positioned on top of the lower support 825 such that the retractable substrate 820 extends across an upper surface 826 of the lower support 825 and underneath the back 210. The coupling frame 805 may also include a reel 810 that is powered by a crank 815 and/or by a motor (e.g., a winch motor or the like). The reel 810 may be coupled to the coupling frame 805 between the first portion 805*a* and the second portion 805*b* such that the reel 810 sits between the back 210 and the lower support 825. The first portion 805*a* and/or the second portion 805*b* may include one or more attachment devices therein for coupling the seat component 200" to an accessory component (i.e., the chair component 400 or the wheelchair component 500), such as the attachment bars 290 described herein with respect to FIGS. 2A and 2B.

Still referring to FIG. 8B, the retractable substrate 820 may be constructed of a flexible material such that the retractable substrate 820 may be wound around the reel 810. In addition, the retractable substrate 820 may also be constructed of a material having a high-friction surface coating on a first surface 821 thereof. That is, the retractable substrate 820 may have a frictional coating on the first surface 821 that frictionally engages with an object contacting the retractable substrate 820, such as a subject's posterior, at a coefficient of friction that is greater than a coefficient of friction associated with a second surface 822 of the retractable substrate 820 and a surface upon which the second surface 822 engages, such as, for example, the upper surface 826 of the lower support 825. One illustrative example of a frictional coating is a coating that includes high density silicon carbide particles embedded within a hard electroless nickel matrix. Another illustrative example of a frictional coating is a rubber or rubber-like coating.

While FIG. 8B depicts the retractable substrate 820 as being a discontinuous length of material wound around the reel 810, this is nonlimiting. For example, in some embodiments, the retractable substrate 820 may be a continuous loop of material wound around a plurality of reels or the like that are disposed on various ends of the lower support 825 (e.g., a distal and a proximal end of the lower support 825). As such, movement of the plurality of reels may cause the continuous loop to move accordingly.

The reel 810 may be wound in a first direction (e.g., a clockwise direction) to retract the retractable substrate 820 (i.e., cause the retractable substrate 820 to move in the −y direction of the coordinate axes of FIG. 8B). In addition, the reel 810 may be wound in a second direction (e.g., in a counterclockwise direction) to extend the retractable substrate 820 (i.e., cause the retractable substrate 820 to move in the +y direction of the coordinate axes of FIG. 8B). When extended, the retractable substrate 820 may extend a distance beyond the lower support 825 (i.e., a distance in the +y direction of the coordinate axes that is beyond an end 827 of the lower support 825). Accordingly, the reel 810 and the retractable substrate 820 may function together as a conveyer belt-like system to pull a subject sitting on the retractable substrate 820 in a location that is distal from the end 827 of the lower support 825 to a location that is overtop the lower support 825, as described in greater detail herein.

Referring again to FIG. 1, the lift component 300 may generally include a longitudinally arranged upper support bar 310 supported on a base frame 303 comprising a plurality of support legs 305. While FIG. 1 depicts a single upper support bar 310 supported by two support legs 305, this is a nonlimiting example. That is, in some embodiments, the lift component 300 may have one or more support bars 310 (e.g, two support bars 310) supported one or more support legs 305 (e.g, a single support leg 305, four support legs 305, etc.).

The base frame 303 generally extends upward in a vertical direction (i.e., generally along the Z axis of the coordinate axes of FIG. 1). The plurality of support legs 305 extend upward from a surface (e.g., a floor) to the upper support bar 310. Each of the plurality of support legs 305 may be spaced apart from one another in the longitudinal direction by the upper support bar 310. In some embodiments, the plurality of support legs 305 may be coupled to the upper support bar 310. In other embodiments, the plurality of support legs 305 may be integrated with the upper support bar 310. In some embodiments, the plurality of support legs 305 may be adjustable such that the support legs 305 can be actuated to raise and lower the upper support bar 310. For example, the plurality of support legs 305 may be actuated to raise and lower the upper support bar 310 in the +/−Z directions of the coordinate axes depicted in FIG. 1.

In some embodiments, each of the support legs 305 may have feet 315. Each foot 315 may be coupled to a corresponding support leg 305 at a location where the support leg 305 contacts a surface such as a floor. Each foot 315 may be generally constructed as a wide base upon which the corresponding support leg 305 is coupled to provide a stable platform for holding the support leg 305. In some embodiments, each foot 315 may include wheels, casters, bearings, or the like to facilitate movement of the lift component 300. For example, the lift component 300 may be transported from a first location (e.g., a bed) to a second location (e.g., the chair component 400 or the wheelchair component 500) by rolling on the wheels, casters, bearings, or the like.

The upper support bar 310 is positioned above the base frame 303 in the vertical direction and extends between the plurality of support legs 305 in the longitudinal direction. The upper support bar 310 is coupled to the plurality of support legs 305 such that the upper support bar 310 can be raised, lowered, and/or tilted with respect to the base frame 303 by extending or retracting one or more of the plurality of support legs 305. The upper support bar 310 generally extends in the horizontal plane (i.e., the X-Y plane as depicted). However, it should be understood that the upper support bar 310 may be tilted with respect to the X-Y plane (i.e., about an axis of rotation generally parallel to the X-axis of the coordinate axes depicted in FIG. 1). While FIG. 1 depicts the upper support bar 310 as being substantially planar, in other embodiments, the upper support bar 310 may be contoured and may include portions that extend out of the horizontal plane.

In some embodiments, the upper support bar 310 may include one or more quick disconnect areas 317 containing quick disconnect slots (not shown) formed therein. The quick disconnect slots may allow for accessories to be attached to the upper support bar 310. In embodiments where the accessories require electrical power or a connection to a control device, the quick disconnect slots may also provide power and/or control means to the accessories through the upper support bar 310. More specifically, the quick disconnect slots may include electrical and/or communications connections integrated therein. The electrical and/or communications connections may be electrically and/or communicatively coupled to a power source and/or a control device, respectively. For example, the electrical and/or communications connections may be coupled to a control unit that is used to extend or retract the cables 225 in embodiments where the cables 225 are extended and retracted from the upper support bar, as described in greater detail herein. In embodiments, the quick disconnect slots may include a channel formed within the upper support bar 310. The quick disconnect slots allow for an electrical or an electronic connection between a control unit and an accessory that is attached in the quick disconnect area, such as, for example, an electronically controlled winch that extends or retracts the cables 225.

In some embodiments, the plurality of quick disconnect areas 317 may be spaced at particular locations along the length of the upper support bar 310. The locations of the quick disconnect areas 317 are not limited by the present disclosure and may generally be any location along the length of the upper support bar 310.

In some embodiments, instead of the quick disconnect areas 317, the attachment rings 321 that receive one of the coupling devices 226 or the alternative locking retraction mechanism 220' (FIGS. 5A and 5B) may be integrated with a clamp 320 that is coupled to the upper support bar 310. Still referring to FIG. 1, each of the plurality of cables 225 is coupled to the upper support bar 310 via a corresponding clamp 320. As such, a plurality of clamps 320 may be coupled to the upper support bar 310. Each of the plurality of clamps 320 may be coupled such that they are slidably movable and repositionable along the length of the upper support bar 310. Accordingly, it should be understood that the clamps 320 (and the cable 225 coupled thereto) are repositionable along the length of the upper support bar 310. In addition, the clamps 320 are coupled to the upper support bar 310 such that the clamps 320 retain the cables 225 coupled thereto on the upper support bar 310.

The clamps 320 are coupled to the upper support bar 310 via one or more clamping features. For example, the clamps 320 may be a "C" shaped clamp having an opening and one or more lips that extend toward the opening in a "C" shape. As such the clamp 320 receives the upper support bar 310 by allowing the upper support bar 310 to pass through the opening. In addition, once the clamp 320 is arranged around the upper support bar 310, the one or more lips thereof prevent the clamp 320 from slipping off the upper support bar 310. In another example, the clamps 320 may include first and second clamp portions, where the first and second clamp portions are brought together around the upper support bar 310 and secured together (e.g., via fasteners, locking hinges, etc.) to securely hold the clamps 320 to the upper support bar 310.

It should be understood that the lift component 300 depicted herein is merely illustrative, and other devices or components that provide a similar functionality (i.e., a support structure for suspending the seat component 200) may be used without departing from the scope of the present disclosure. That is, any commercially available lifting/support device may be used according to the present embodiment. One illustrative example is the FreeSpan™ lift system manufactured by Hill-Rom (Batesville, Ind.). Another illustrative example is a mobile lift such as a Viking® lift system manufactured by Liko AB (Luleå, Sweden).

Figure 9A:
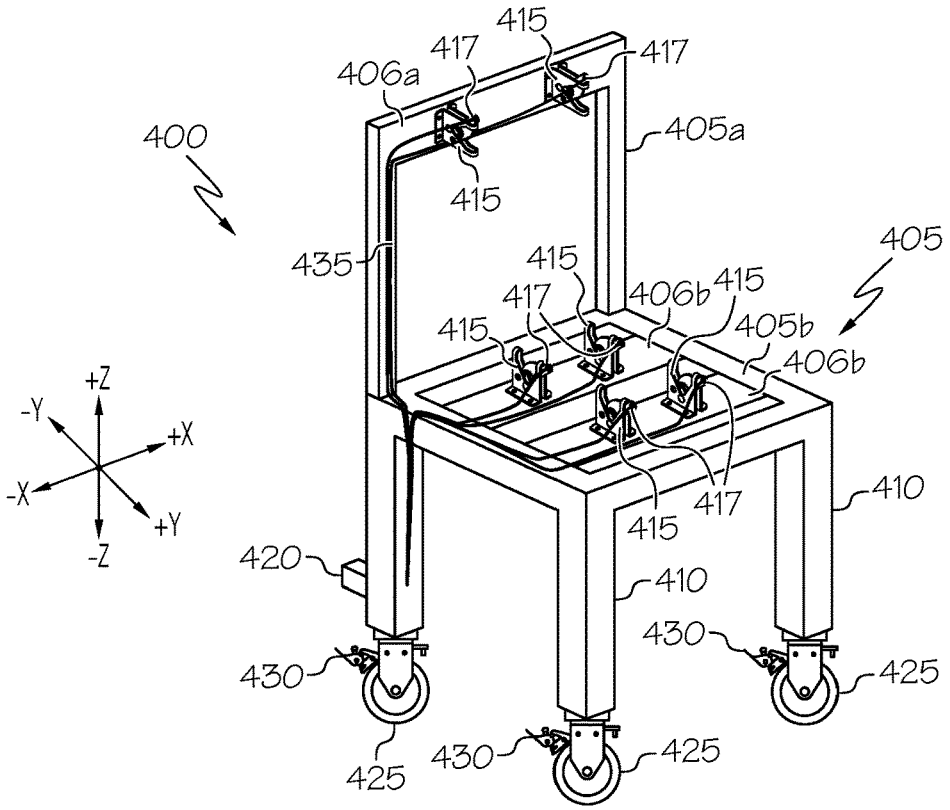
FIG. 9A schematically depicts an illustrative chair component of a modular chair system according to one or more embodiments shown and described herein.
Figure 9B:
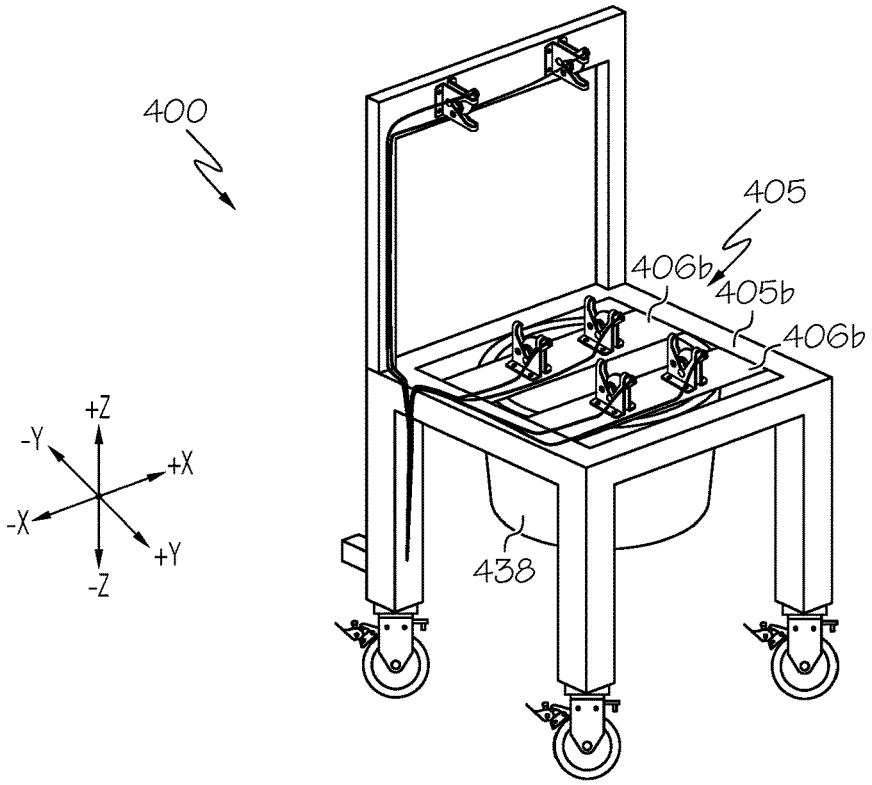
FIG. 9B schematically depicts an illustrative chair component of a modular chair system having an incontinence aid integrated therein according to one or more embodiments shown and described herein.

Referring now to FIGS. 1 and 9A-9B, the chair component 400 may generally include a chair frame 405 having an upper frame member 405*a* coupled to a lower frame member 405*b*. The chair frame 405 may generally be supported on a plurality of legs 410. Each of the plurality of legs 410 generally extends upward in a vertical direction (i.e., generally along the Z axis of the coordinate axes of FIG. 1) from a surface (e.g., a floor) to the lower frame member 405*b*. Each of the plurality of legs 410 may be spaced apart from one another in the longitudinal direction by the lower frame member 405*b*. In some embodiments, the plurality of legs 410 may be coupled to the lower frame member 405*b*. In other embodiments, the plurality of legs 410 may be integrated with the lower frame member 405*b*.

In some embodiments, each of the legs 410 may be pivotably coupled to a corresponding wheel 425 that facilitates movement of the chair component 400 between various locations. Each of the wheels 425 may be, for example, locking caster wheels or the like. Accordingly, in some embodiments, each wheel 425 may incorporate a locking mechanism 430.

The lower frame member 405*b* is positioned above the plurality of legs 410 in the vertical direction and extends between the plurality of legs 410 in the longitudinal direction. The lower frame member 405*b* is coupled to the plurality of legs 410 such that the lower frame member 405*b* is supported by the plurality of legs 410. In some embodiments, the plurality of legs 410 may be integrated with at least a portion of the lower frame member 405*b*. The lower frame member 405*b* generally extends in the horizontal plane (i.e., the X-Y plane as depicted).

The upper frame member 405*a* is positioned above the lower frame member 405*b* in the vertical direction and extends in the vertical direction from the lower frame member 405*b*. In addition, the upper frame member 405*a* extends across a length of the lower frame member 405*b* in the horizontal direction. The upper frame member 405*a* generally extends in the vertical plane (i.e., the X-Z plane as depicted). However, it should be understood that the upper frame member 405*a* may be tilted with respect to the X-Z plane (i.e., about an axis of rotation generally parallel to the X-axis of the coordinate axes depicted in FIG. 1).

The upper frame member 405*a* is coupled to the lower frame member 405*b* and/or the plurality of legs 410 such that the upper frame member is supported by the lower frame member 405*b* and/or the plurality of legs 410. In some embodiments, the plurality of legs 410 and/or the lower frame member 405*b* may be integrated with at least a portion of the lower frame member 405*b*. For example, the plurality of legs 410 may extend beyond the lower frame member 405*b* to form the upper frame member 405*a*. In another example, a portion of the lower frame member 405*b* may extend out of the horizontal plane upward in the vertical direction to form the upper frame member 405*a*.

The lower frame member 405*b* generally includes one or more cross bars 406*b* that extend across a portion of the lower frame member 405*b* in the longitudinal direction. For example, the one or more cross bars 406*b* may be above the lower frame member 405*b* in the vertical direction and may generally extend in the horizontal plane. In addition, the upper frame member 405*a* generally includes one or more cross bars 406*a* that extend across a portion of the upper frame member 405*a* in the longitudinal direction. The one or more cross bars 406*a* also generally extend in the horizontal plane. The one or more cross bars 406*a*, 406*b* may generally provide a support for a plurality of chair latch mechanisms 415. That is, the plurality of chair latch mechanisms 415 may be coupled to the one or more cross bars 406*b* above the one or more cross bars 406*b* in the vertical direction. The plurality of chair latch mechanisms 415 may also be coupled to the one or more cross bars 406*a* in front of the one or more cross bars 406 (i.e., towards the +y direction of the coordinate axes depicted in FIG. 1). Each of the chair latch mechanisms 415 is positioned to receive the attachment bars 290 located on the seat 205 and the back 210, respectively.

Figure 10A:
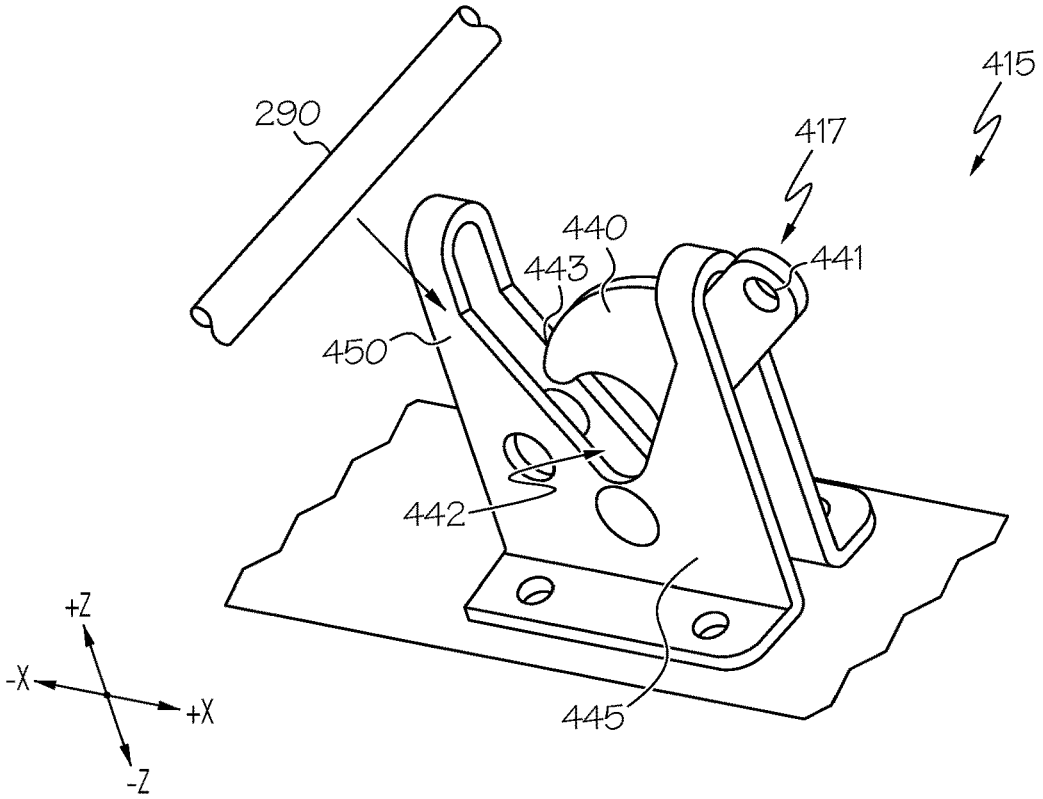
FIG. 10A schematically depicts an illustrative latch mechanism and a corresponding attachment point of a modular chair system according to one or more embodiments shown and described herein.
Figure 10B:
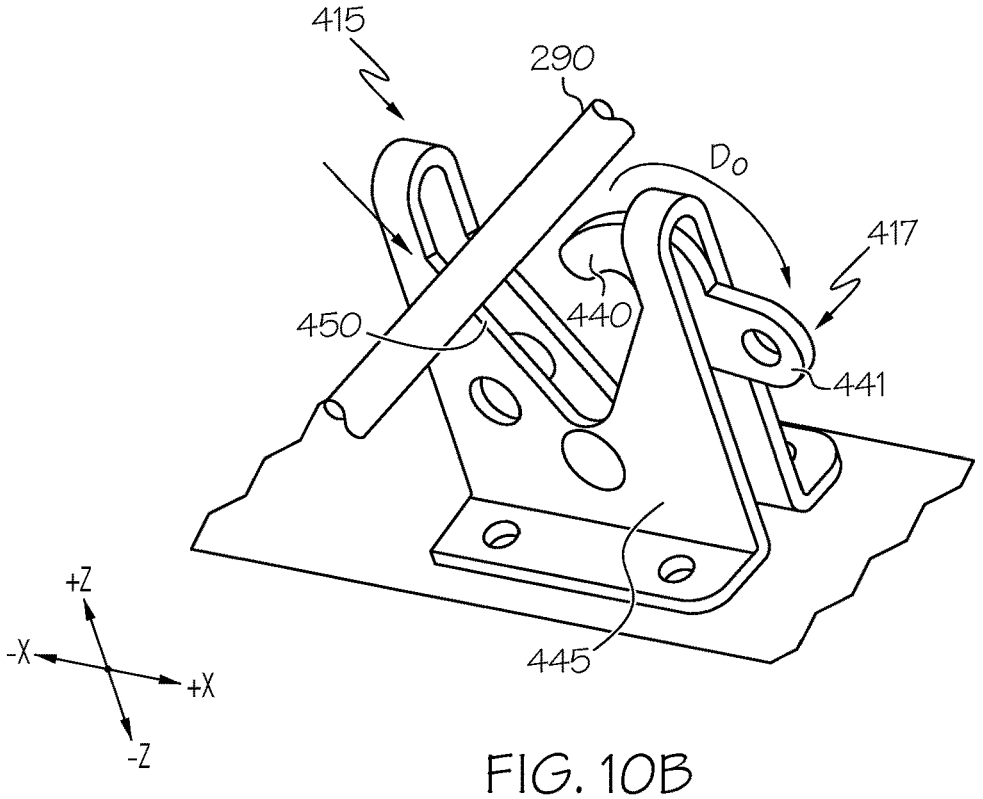
FIG. 10B schematically depicts movement of an illustrative attachment point into an illustrative latch mechanism of a modular chair system according to one or more embodiments shown and described herein.
Figure 10C:
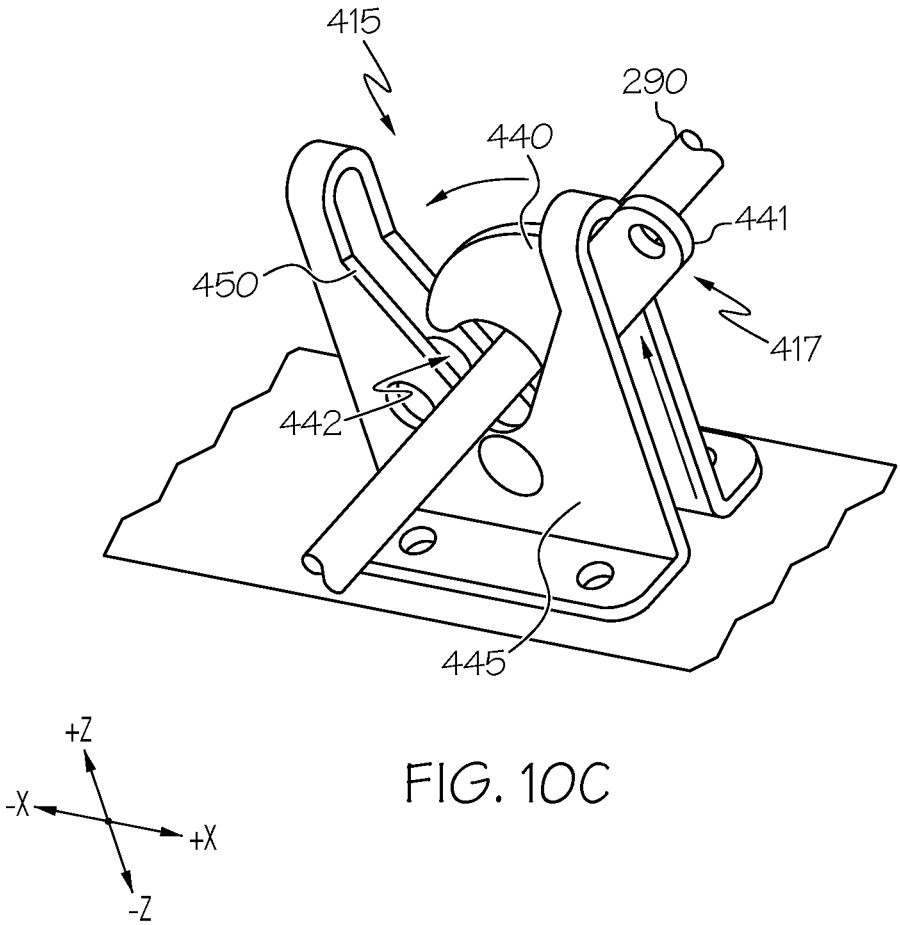
FIG. 10C schematically depicts an illustrative holding of an attachment point in an illustrative latch mechanism of a modular chair system according to one or more embodiments shown and described herein.
Figure 10D:
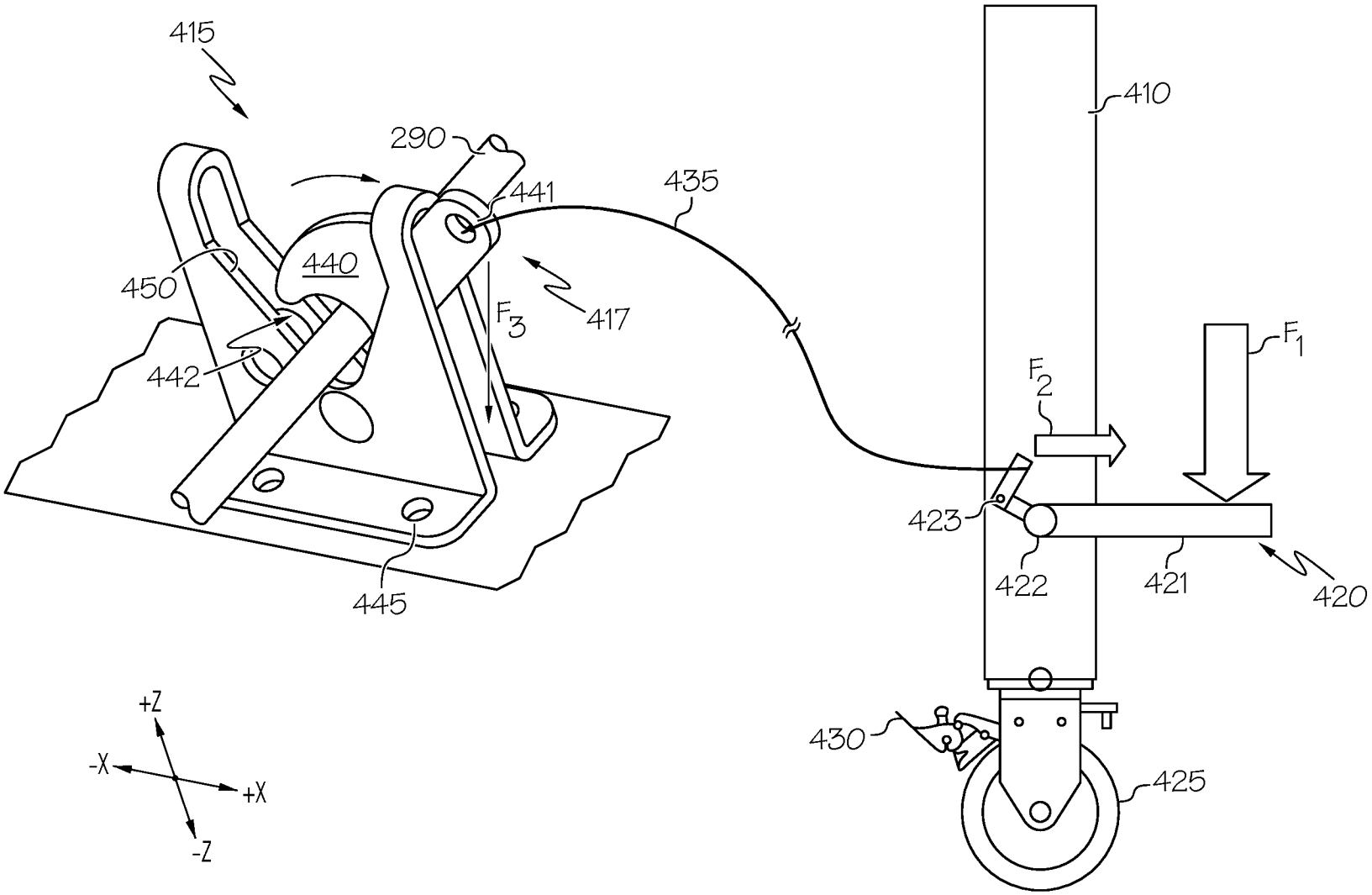
FIG. 10D schematically depicts an illustrative release mechanism for releasing a latch mechanism of a modular chair system according to one or more embodiments shown and described herein.

Referring now to FIGS. 10A-10D, one of the plurality of chair latch mechanisms 415 is depicted in greater detail. As shown in FIGS. 10-10D, the chair latch mechanism 415 includes a body 445 having a fixed slide portion 450 for receiving a corresponding attachment bar 290 and a release mechanism 417 pivotably coupled to the body 445. The release mechanism 417 may include a retention piece 440 coupled to a release arm 441. The release mechanism 417 may generally be biased in a closed position by a biasing assembly (e.g., a spring, not shown) as depicted in FIGS. 10A, 10C, and 10D. When biased in the closed position, the retention piece 440 of the release mechanism 417 may be curved or angled such that the retention piece 440 forms an opening 442 with the fixed slide portion 450 of the body 445. That is, the opening 442 is surrounded by the retention piece 440 and the slide portion 450 of the body 445. The opening 442 may generally be sized and shaped such that the corresponding attachment bar 290 can be held within the opening 442 and surrounded by the retention piece 440 and the slide portion 450 of the body 445, as depicted in FIGS. 10C and 10D. The retention piece 440 may further be curved or angled such that a downward force applied to an end portion 443 of the retention piece 440 overcomes the biasing force on the retention piece and causes the retention piece to slide in an opening direction $D_O$ as depicted in FIG. 10B. Such a downward force may be applied by sliding the attachment bar 290 downward (i.e., generally in the −z direction of the coordinate axes of FIG. 10B) along the slide portion 450 of the body 445 such that the slide portion 450 guides the attachment bar 290 into the opening 442. The force applied to the retention piece 440 is then released and the biasing force causes the retention piece 440 to snap back in a closed positioning over the attachment bar 290, as depicted in FIG. 10C. The biasing force further maintains the positioning of the retention piece 440 over the attachment bar 290 such that the attachment bar does not slip out of the opening 442.

Referring now to FIGS. 1 and 10D, the chair component 400 may further include a latch release mechanism 420. The latch release mechanism 420 may generally be pivotably coupled to one or more portions of the chair component 400. For example, as shown in FIGS. 1 and 10D, the latch release mechanism 420 may be pivotably coupled to one of the plurality of legs 410 such that the latch release mechanism 420 is accessible as a foot pedal or the like. However, it should be understood that the latch release mechanism 420 may also be coupled elsewhere with respect to the chair component 400, such as coupled to the upper frame member 405*a*.

The latch release mechanism 420 may be pivotally coupled to one of the plurality of legs 410 such that the latch release mechanism 420 pivots about a pivot point 422. As such, a movement on a first portion 421 of the latch release mechanism 420 located on a first side of the pivot point 422 may cause a corresponding movement on a second portion 423 of the latch release mechanism located on a second side of the pivot point 422 that is opposite the first side. In some embodiments, the latch release mechanism 420 may be biased to a particular position such that a counteracting force is necessary to overcome the biasing force to pivot the latch release mechanism 420 and such that the latch release mechanism 420 returns to the particular position after the counteracting force is ceased.

As shown in FIG. 10D, the latch release mechanism 420 may be coupled to one or more release cables 435. The one or more release cables 435 may further be coupled to the release arm 441 on a corresponding one of the release mechanisms 417 of the chair latch mechanism 415. The release cables 435 may extend along one or more portions of the chair component 400 and may be particularly positioned such that when the latch release mechanism 420 is depressed (e.g., via the downward force $F_1$), the latch release mechanism 420 exerts the pulling force $F_2$ on the one or more release cables 435, which, in turn, cause the release cables 435 to exert a releasing force $F_3$ in a downward direction (i.e., in the −z direction of the coordinate axes depicted in FIG. 10D) that overcomes the biasing force holding the retention piece 440 in the closed position such that the retention piece 440 pivots to open the opening 442. Accordingly, the attachment bar 290 may thereafter be removed from the opening 442.

It should be understood that the latch release mechanism 420 is merely illustrative, and other devices or components that can releasably hold the attachment bars 290 are also included within the scope of the present disclosure.

Referring now to FIGS. 1 and 9B, in some embodiments, the lower frame member 405*b* may support an incontinence aid 438. For example, as shown in FIG. 9B, the incontinence aid 438 may be coupled between two of the cross bars 406*b* extending across the length of the lower frame member 405*b*. The incontinence aid 438 is not limited by this disclosure, and may generally be any component that is used for the collection and/or disposal of waste material that may be released onto the lower frame member 405*b* (e.g., when a subject sitting in the seat component 200 coupled to the chair component 400 releases his/her bladder). For example, the incontinence aid 438 may be a bed pan, an absorptive material, a device coupled to a vacuum, and/or the like. The incontinence aid 438 may be removably attached to the lower frame member 405*b* such that the incontinence aid 438 can be removed for cleaning, disposal, replacement, and/or the like.

Figure 11:
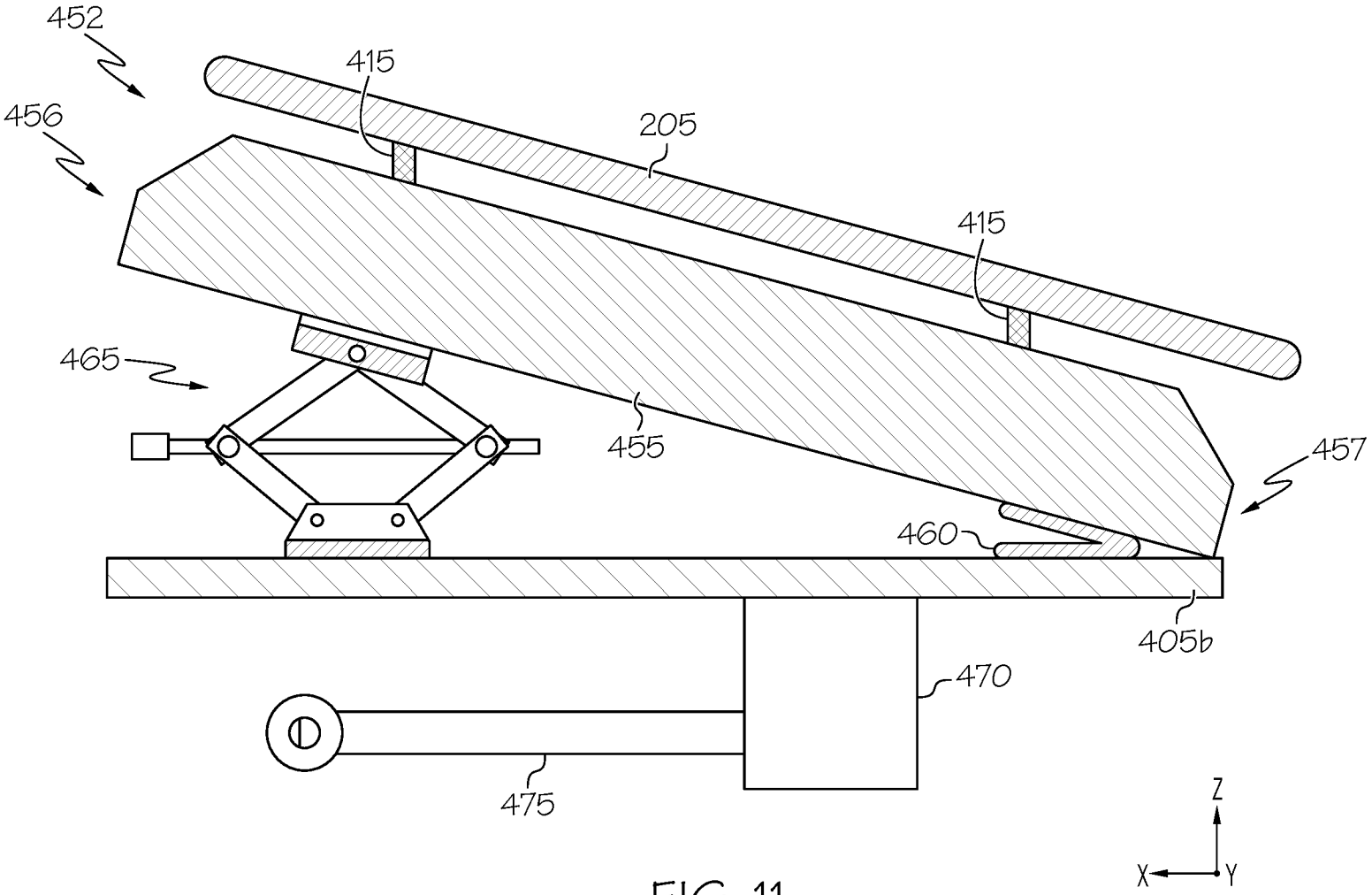
FIG. 11 schematically depicts an illustrative seat tilting mechanism of a chair component of a modular chair system according to one or more embodiments shown and described herein.

In some embodiments, the chair component 400 may further incorporate a device for angling the seat component 200 when the seat component 200 and the chair component 400 are coupled together so as to facilitate a subject's movement out of the seat component 200. Referring to FIGS. 1 and 11, an illustrative seat tilting device 452 is depicted. The seat tilting device 452 may generally be coupled to one or more portions of the chair frame 405, such as, for example, the lower frame member 405*b*. The seat tilting device 452 may further be coupled between the chair frame 405 and the seat 205 of the seat component 200. That is, the chair latch mechanisms 415 may be coupled to the seat tilting device 452 such that the seat tilting device 452 is between the chair latch mechanisms 415 and the chair frame 405.

The seat tilting device 452 may be, for example, a scissor lift device which includes a support plate 455 having a first end 456 and a second end 457, a lifting mechanism 465, a central shaft 470, and a counterweight 475. The support plate 455 may generally extend in the longitudinal direction and may generally be planar. The support plate 455 may be coupled to the lower frame member 405*b* such that the support plate 455 can be tilted off the lower frame member 405*b* and rotated relative to the y axis of the coordinate axes depicted in FIG. 11. That is, the second end 457 of the support plate 455 may be coupled to the lower frame member 405*b* via a hinge 460, such as a piano hinge or the like. In addition, the first end 456 of the support plate may be coupled to the lower frame member 405*b* via the lifting mechanism 465.

The lifting mechanism 465 may be movable between a contracted position and an extended position (as shown in FIG. 11) to lift the first end 456. That is, the lifting mechanism 465 may generally move the first end 456 of the support plate 455 in the vertical direction (i.e., along the z axis of the coordinate axes depicted in FIG. 11). Accordingly, the hinge 460 may allow the second end 457 to pivot relative to the lower frame member 405*b* as the lifting mechanism 465 moves the first end 456 of the support plate 455. The lifting mechanism 465 may be actuated to raise or lower the first end 456 of the support plate 455 via a manual control mechanism (e.g., a crank, manual hydraulic pump, or the like) or an automatic control mechanism (e.g., an electromechanically controlled actuator, hydraulic pump, or the like). While FIG. 11 depicts the lifting mechanism 465 as a scissor lift device, this is merely an illustrative example. That is, other devices or mechanisms that provide a lifting motion may also be used to lift the first end 456 of the support plate 455 without departing from the scope of the present disclosure. Illustrative examples of other devices or mechanisms include, but are not limited to, a linear actuator, a screw actuator, a wheel and axle actuator, a cam actuator, or the like.

Still referring to FIGS. 1 and 11, since actuation of the lifting mechanism 465 to raise the support plate 455 may cause the center of gravity of the chair component 400 to shift to a point that could tip the chair component 400, the seat tilting device 452 may further include the counterweight 475 to maintain the center of gravity of the chair component 400. The counterweight 475 may generally be coupled via the central shaft 470 to the lower frame member 405*b*, such as, for example, below the lower frame member 405*b* in the vertical direction. The counterweight 475 may be in a fixed location or may be adjustable to extend distally away from the central shaft 470 to adjust the center of gravity of the chair component 400 as needed. In some embodiments, the counterweight 475 may be manually adjusted. In other embodiments, a distal extension movement of the counterweight 475 may be coupled to the movement of the lifting mechanism 465 such that the counterweight 475 moves distally at substantially the same time the lifting mechanism 465 moves the first side 456 upwards in the vertical direction. That is, an actuator or the like may be coupled to both the lifting mechanism 465 and the counterweight 475 to move both the lifting mechanism 465 and the counterweight 475 at substantially the same time. For example, a screw drive actuator coupled to the lifting mechanism 465 and the counterweight 475 may rotate, thereby causing an extension of both the lifting mechanism 465 and the counterweight 475.

Figure 12:
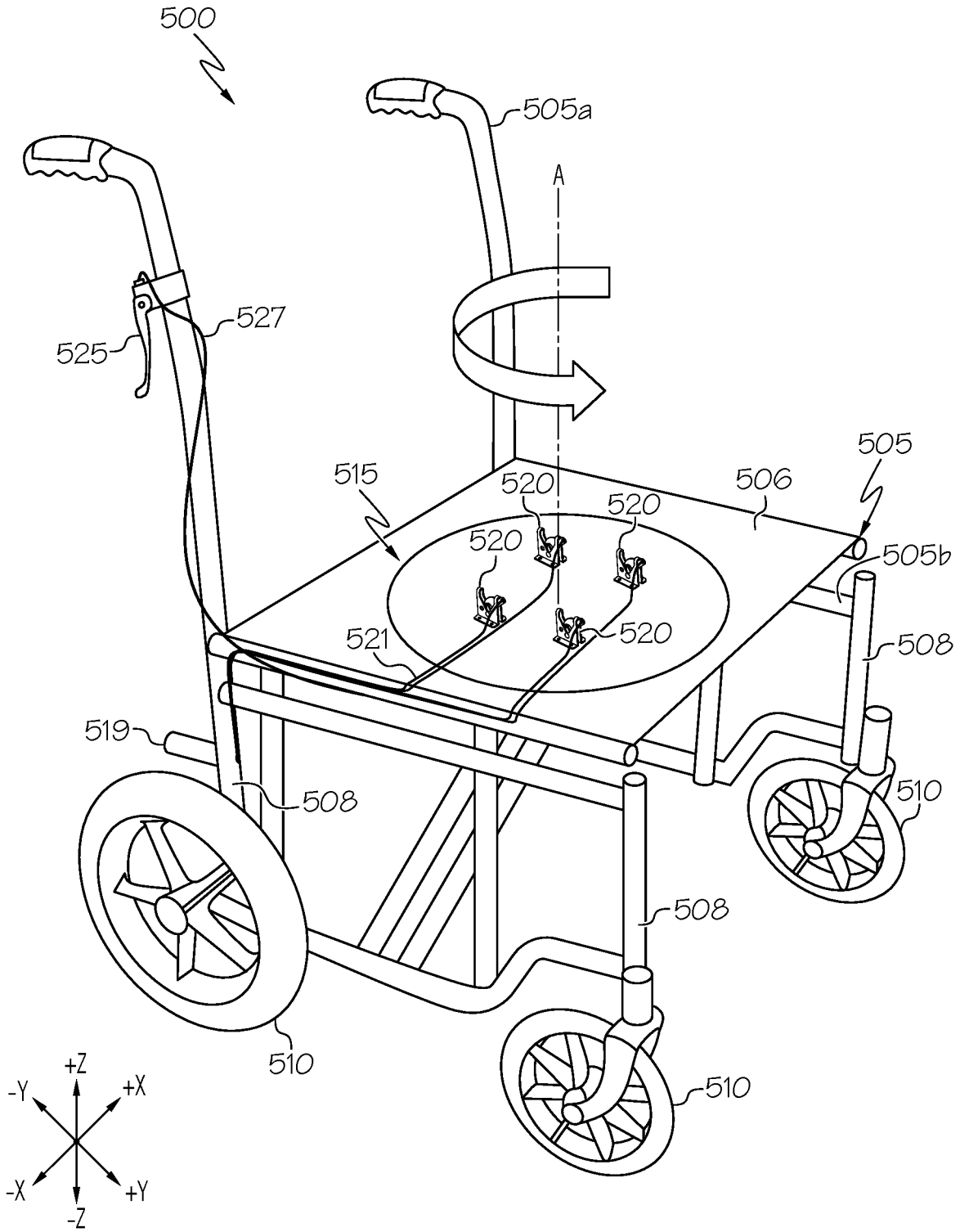
FIG. 12 schematically depicts an illustrative wheelchair component of a modular chair system according to one or more embodiments shown and described herein.

Referring now to FIGS. 1 and 12, the wheelchair component 500 may generally include a wheelchair frame 505 having an upper frame member 505*a* coupled to a lower frame member 505*b*. The wheelchair frame 505 may generally be supported on a plurality of legs 508 coupled to wheels 510. Each of the plurality of legs 508 generally extends upward in a vertical direction (i.e., generally along the Z axis of the coordinate axes of FIG. 1) from the wheels 510 to the lower frame member 505*b*. Each of the plurality of legs 508 may be spaced apart from one another in the longitudinal direction by the lower frame member 505*b*. In some embodiments, the plurality of legs 508 may be coupled to the lower frame member 505*b*. In other embodiments, the plurality of legs 508 may be integrated with the lower frame member 505*b*.

The wheels 510 are not limited by this disclosure, and may generally be any wheels, particularly wheels adapted for a wheelchair. That is, the wheels 510 may include certain features typically found on certain wheelchair wheels, such as, for example, grip bars for spinning the wheels, brakes, and/or the like. In some embodiments, certain ones of the wheels 510 disposed on the front of the wheelchair component 500 (i.e., towards the +y direction of the coordinate axes of FIG. 1) may be smaller in diameter than certain other ones of the wheels 510 disposed on the rear of the wheelchair component 500 (i.e., towards the −y direction of the coordinate axes of FIG. 1). In some embodiments, at least one of the wheels 510 may be pivotably coupled to one of the plurality of legs 508 to facilitate directional changes when moving the wheelchair component 500. In some embodiments, the wheels 510 may be sized such that the wheels 510 do not hinder rotational movement of a turntable when a subject is positioned thereon, as described in greater detail herein.

The lower frame member 505*b* is positioned above the plurality of legs 508 in the vertical direction and extends between the plurality of legs 508 in the longitudinal direction. The lower frame member 505*b* is coupled to the plurality of legs 508 such that the lower frame member 505*b* is supported by the plurality of legs 508. In some embodiments, the plurality of legs 508 may be integrated with at least a portion of the lower frame member 505*b*. The lower frame member 505*b* generally extends in the horizontal plane (i.e., the X-Y plane as depicted).

The upper frame member 505*a* is positioned above the lower frame member 505*b* in the vertical direction and extends in the vertical direction from the lower frame member 505*b*. In addition, the upper frame member 505*a* extends across a length of the lower frame member 505*b* in the horizontal direction. The upper frame member 505*a* generally extends in the vertical plane (i.e., the X-Z plane as depicted). However, it should be understood that the upper frame member 505*a* may be tilted with respect to the X-Z plane (i.e., about an axis of rotation generally parallel to the X-axis of the coordinate axes depicted in FIG. 1).

The upper frame member 505*a* is coupled to the lower frame member 505*b* and/or the plurality of legs 508 such that the upper frame member 505*a* is supported by the lower frame member 505*b* and/or the plurality of legs 508. In some embodiments, the plurality of legs 508 and/or the lower frame member 505*b* may be integrated with at least a portion of the lower frame member 505*b*. For example, the plurality of legs 508 may extend beyond the lower frame member 505*b* to form the upper frame member 505*a*. In another example, a portion of the lower frame member 505*b* may extend out of the horizontal plane upward in the vertical direction to form the upper frame member 505*a*.

The lower frame member 505*b* generally includes a support plate 506 that extends across a portion of the lower frame member 505*b* in the longitudinal direction. The support plate 506 may be above the lower frame member 505*b* in the vertical direction, may generally be planar, and may extend in the horizontal plane. The support plate 506 may include a turntable 515. The turntable 515 may be coupled to the support plate 506 above the support plate 506 in the vertical direction, may be planar, and may extend in the horizontal plane. The turntable 515 may further support a plurality of wheelchair latch mechanisms 520 thereon. That is, the plurality of wheelchair latch mechanisms 520 may be coupled to the turntable 515 above the turntable in the vertical direction. The wheelchair latch mechanisms 520 are further positioned to receive the attachment bars 290 located on the seat 205 and the back 210, respectively. The wheelchair latch mechanisms 520 may be, for example, similar to the chair latch mechanisms 415 described herein with respect to FIGS. 10A-10D.

Still referring to FIGS. 1 and 12, the wheelchair component 500 may further include a latch release mechanism 519. The latch release mechanism 519 may generally be pivotably coupled to one or more portions of the wheelchair component 500. For example, as shown in FIGS. 1 and 12, the latch release mechanism 519 may be pivotably coupled to one of the plurality of legs 508 such that the latch release mechanism 519 is accessible as a foot pedal or the like. However, it should be understood that the latch release mechanism 519 may also be coupled elsewhere with respect to the wheelchair component 500, such as coupled to the upper frame member 505*a*. The latch release mechanism 519 may be coupled to a plurality of release cables 521 and may function in a manner similar to that of the latch release mechanism 420 described herein with respect to FIGS. 1 and 10D to release the wheelchair latch mechanisms 520 when coupled to the attachment bars 290 (FIGS. 2A-2B) of the seat component 200. It should be understood that the plurality of release cables 521 may extend between the latch release mechanism 519 and the wheelchair latch mechanisms 520 in such a manner so as to not hinder the rotational movement of the turntable 515, as described herein.

Figure 13A:
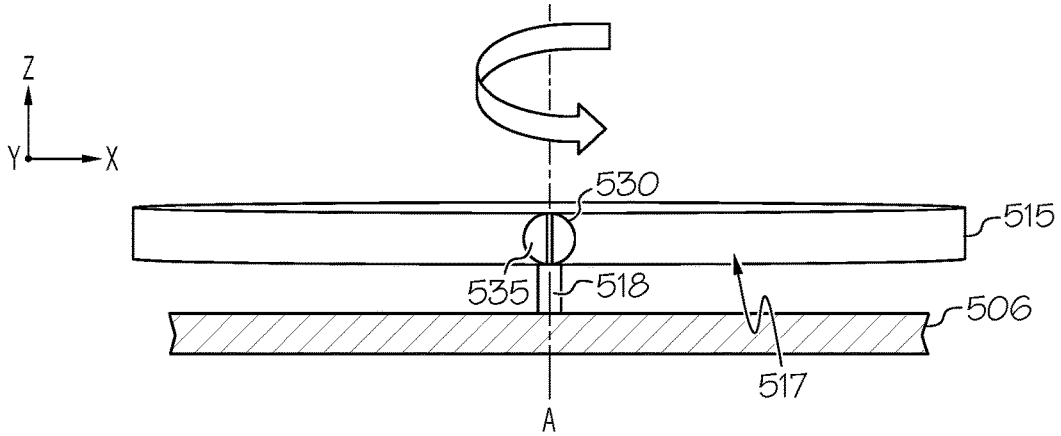
FIG. 13A schematically depicts a side view of an illustrative turntable of a wheelchair component of a modular chair system according to one or more embodiments shown and described herein.
Figure 13B:
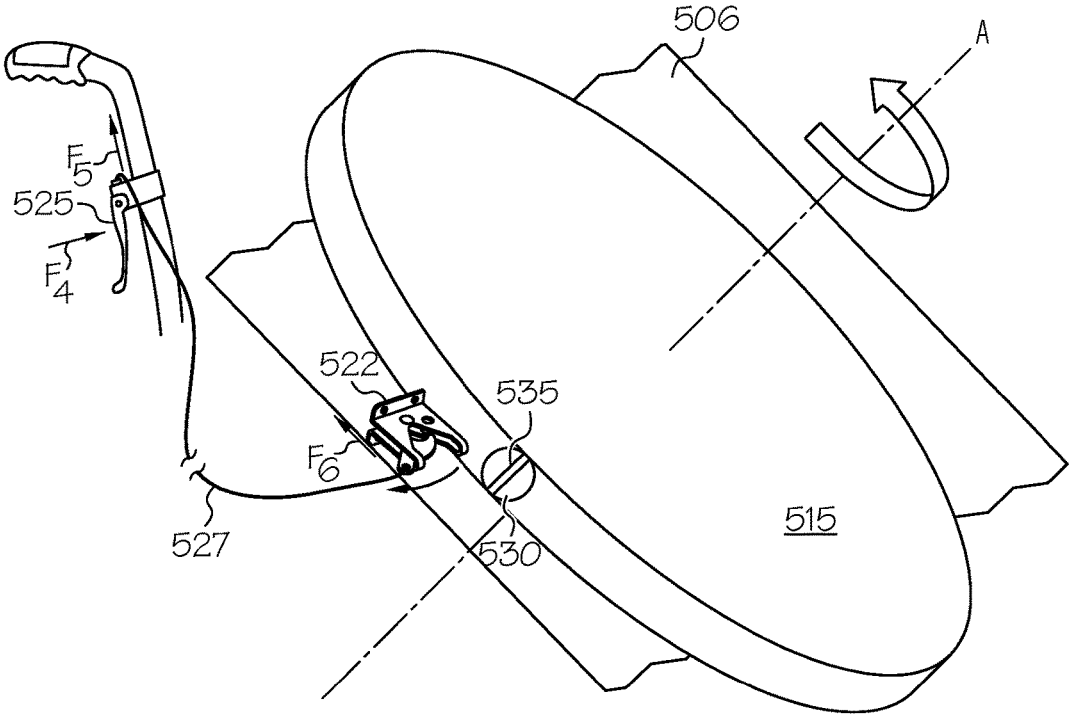
FIG. 13B schematically depicts a perspective view of an illustrative turntable having a latching mechanism according to one or more embodiments shown and described herein.

Referring now to FIGS. 1 and 13A-13B, the turntable 515 is shown in greater detail. The turntable 515 is rotatably mounted to the support plate 506 via a spindle 518. That is, the turntable 515 rotates about an axis A that extends through the spindle 518. The spindle 518 is coupled to the support plate 506 above the support plate 506 in the vertical direction and the turntable 515 is rotatably coupled to the spindle 518 above the spindle 518 in the vertical direction.

The turntable 515 may include a sidewall 517 having an anchor, attachment bar, or the like. For example, in the embodiment shown in FIGS. 13A and 13B, the sidewall 517 may have a recess 530 therein. The recess 530 may contain an attachment bar 535 that is anchored to sidewalls of the recess 530 and does not protrude from the recess 530. The attachment bar 535 may be held in a fixed position within the recess 530 such that the attachment bar 535 does not move. That is, the attachment bar 535 is secured to the turntable 515 via anchors, screws, adhesives, and/or the like to prevent movement of the attachment bar 535 with respect to the turntable 515. In some embodiments, the attachment bar 535 may be molded of the same material as the turntable 515. That is, the turntable 515 may be formed by removing material for the recess 530 around material for the attachment bar 535 or molding the turntable 515 with the recess 530 and the attachment bar 535 formed therein.

The attachment bar 535 may be positioned within the recess 530 such that the attachment bar 535 provides a latching point for locking the turntable 515 in place such that the turntable 515 does not rotate. The attachment bar 535 may generally be shaped and sized so as to fit within a corresponding latch 522 coupled to the support plate 506. For example, the attachment bar 535 may be cylindrical in shape in some embodiments. However, it should be understood that the attachment bar 535 may not be a bar at all, but rather may be formed into other shapes that provide a latching point for locking the turntable 515 in place, such as a hook shape, a ring shape, and/or the like.

While FIGS. 13A-13B depict a single recess 530 and a corresponding attachment bar 535, the present disclosure is not limited to such. That is, the turntable 515 may have any number of recesses 530 and attachment bars 535 for locking the turntable 515.

The turntable 515 may generally be locked in place by the latch 522 that is coupled to the support plate 506. The latch 522 may be arranged and configured in a manner similar to that of chair latch mechanism 415 described with respect to FIGS. 1-10D. Still referring to FIGS. 1 and 13A-13B, the latch 522 may be opened to release the attachment bar 535 and allow rotation of the turntable 515 upon activation of a latch release pedal 525 coupled to a portion of the wheelchair component 500, such as, for example, the upper frame member 505*a*. The latch release pedal 525 may generally be arranged and configured in a manner similar to that of the latch release mechanism 420 as described herein with respect to FIGS. 1 and 10D such that the latch release pedal 525 pulls on a latch release cable 527 that is coupled to the latch 522 such that the pulling force causes the latch 522 to open. More specifically, a compressing force $F_4$ exerted on the latch release pedal 525 causes a pulling force $F_5$ on the latch release cable 527, which, in turn, causes releasing force $F_6$ on the latch 522.

Figure 14:
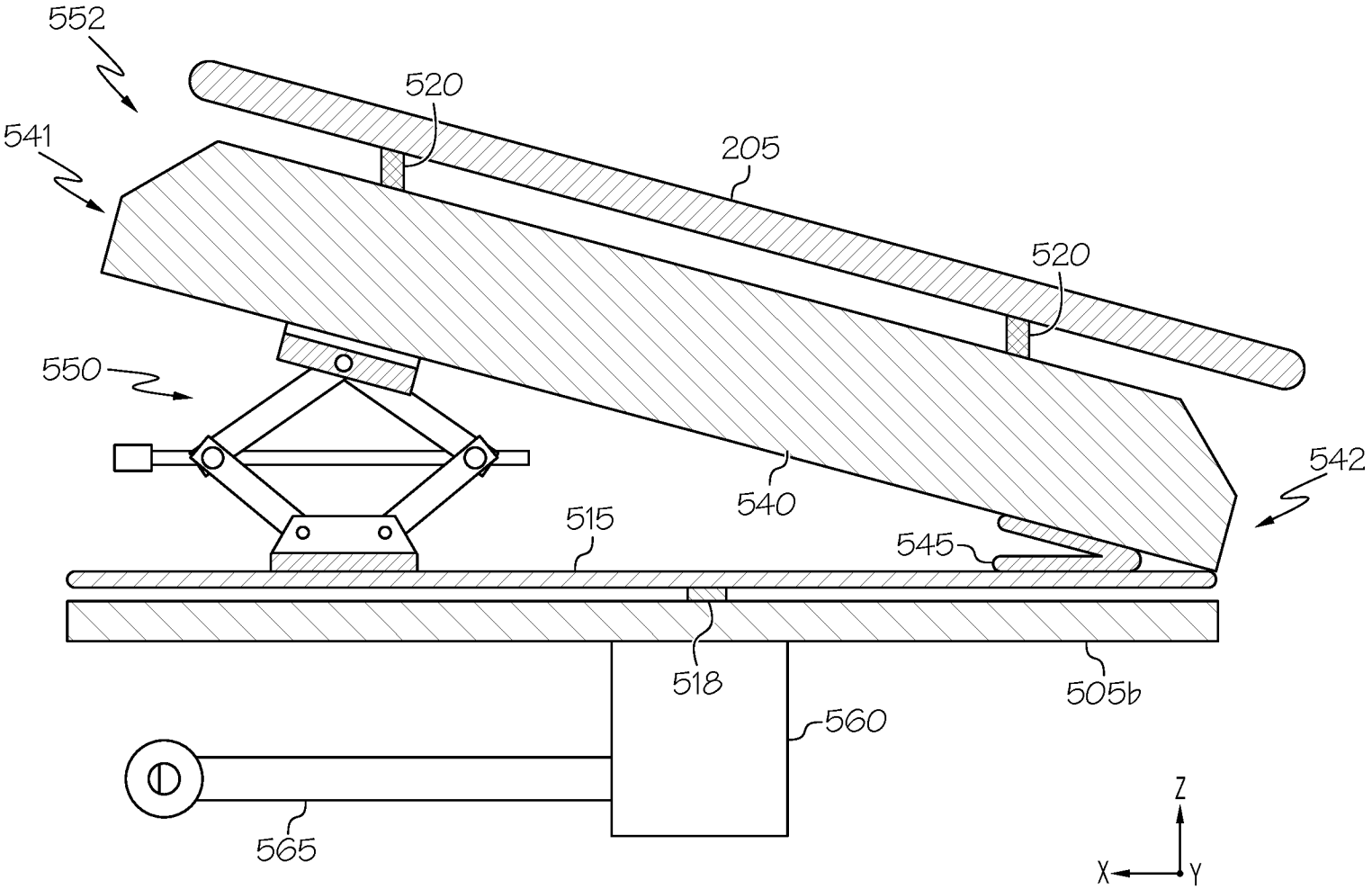
FIG. 14 schematically depicts an illustrative seat tilting mechanism of a wheelchair component of a modular chair system according to one or more embodiments shown and described herein.

Referring again to FIG. 1, in some embodiments, the wheelchair component 500 may further incorporate a device for angling the seat component 200 when the seat component 200 and the wheelchair component 500 are coupled together so as to facilitate a subject's movement out of the seat component 200. Referring also to FIG. 14, an illustrative seat tilting device 552 is depicted. The seat tilting device 552 may generally be coupled to one or more portions of the wheelchair frame 505, such as, for example, the lower frame member 505*b* and/or the turntable 515. In some embodiments, the seat tilting device 552 may be integrated with the turntable 515. The seat tilting device 552 may further be coupled between the wheelchair frame 505 and the seat 205 of the seat component 200. That is, the wheelchair latch mechanisms 520 may be coupled to the seat tilting device 552 such that the seat tilting device 552 is between the wheelchair latch mechanisms 520 and the wheelchair frame 505 and/or the turntable 515.

The seat tilting device 552 may be, for example, a scissor lift device which includes a support plate 540 having a first end 541 and a second end 542, a lifting mechanism 550, a central shaft 560, and a counterweight 565. The support plate 540 may generally extend in the longitudinal direction and may generally be planar. The support plate 540 may be coupled to the turntable 515 such that the support plate 540 can be tilted off the turntable 515 and rotated relative to the y axis of the coordinate axes depicted in FIG. 14. That is, the second end 542 of the support plate 540 may be coupled to the turntable 515 via a hinge 545, such as a piano hinge or the like. In addition, the first end 541 of the support plate 540 may be coupled to the turntable 515 via the lifting mechanism 550.

The lifting mechanism 550 may be movable between a contracted position and an extended position (as shown in FIG. 14) to lift the first end 541 of the support plate 540. That is, the lifting mechanism 550 may generally move the first end 541 of the support plate 540 in the vertical direction (i.e., along the z axis of the coordinate axes depicted in FIG. 14). Accordingly, the hinge 545 may allow the second end 542 to pivot relative to the turntable 515 as the lifting mechanism 550 moves the first end 541 of the support plate 540. The lifting mechanism 550 may be actuated to raise or lower the first end 541 of the support plate 540 via a manual control mechanism (e.g., a crank, manual hydraulic pump, or the like) or an automatic control mechanism (e.g., an electromechanically controlled actuator, hydraulic pump, or the like). While FIG. 14 depicts the lifting mechanism 550 as a scissor lift device, this is merely an illustrative example. That is, other devices or mechanisms that provide a lifting motion may also be used to lift the first end 541 of the support plate 540 without departing from the scope of the present disclosure. Illustrative examples of other devices or mechanisms include, but are not limited to, a linear actuator, a screw actuator, a wheel and axle actuator, a cam actuator, or the like.

Still referring to FIGS. 1 and 14, since actuation of the lifting mechanism 550 to raise the support plate 540 may cause the center of gravity of the wheelchair component 500 to shift to a point that could tip the wheelchair component 500, the seat tilting device 552 may further include the counterweight 565 to maintain the center of gravity of the wheelchair component 500. The counterweight 565 may generally be coupled via the central shaft 560 to the lower frame member 505*b*, such as, for example, below the lower frame member 505*b* in the vertical direction. The counterweight 565 may be in a fixed location or may be adjustable to extend distally away from the central shaft 560 to adjust the center of gravity of the wheelchair component 500 as needed. In some embodiments, the counterweight 565 may be manually adjusted. In other embodiments, a distal extension movement of the counterweight 565 may be coupled to the movement of the lifting mechanism 550 such that the counterweight 565 moves distally at substantially the same time the lifting mechanism 550 moves the first end 541 upwards in the vertical direction. That is, an actuator or the like may be coupled to both the lifting mechanism 550 and the counterweight 565 to move both the lifting mechanism 550 and the counterweight 565 at substantially the same time. For example, a screw drive actuator coupled to the lifting mechanism 550 and the counterweight 565 may rotate, thereby causing an extension of both the lifting mechanism 550 and the counterweight 565.

Figure 15:
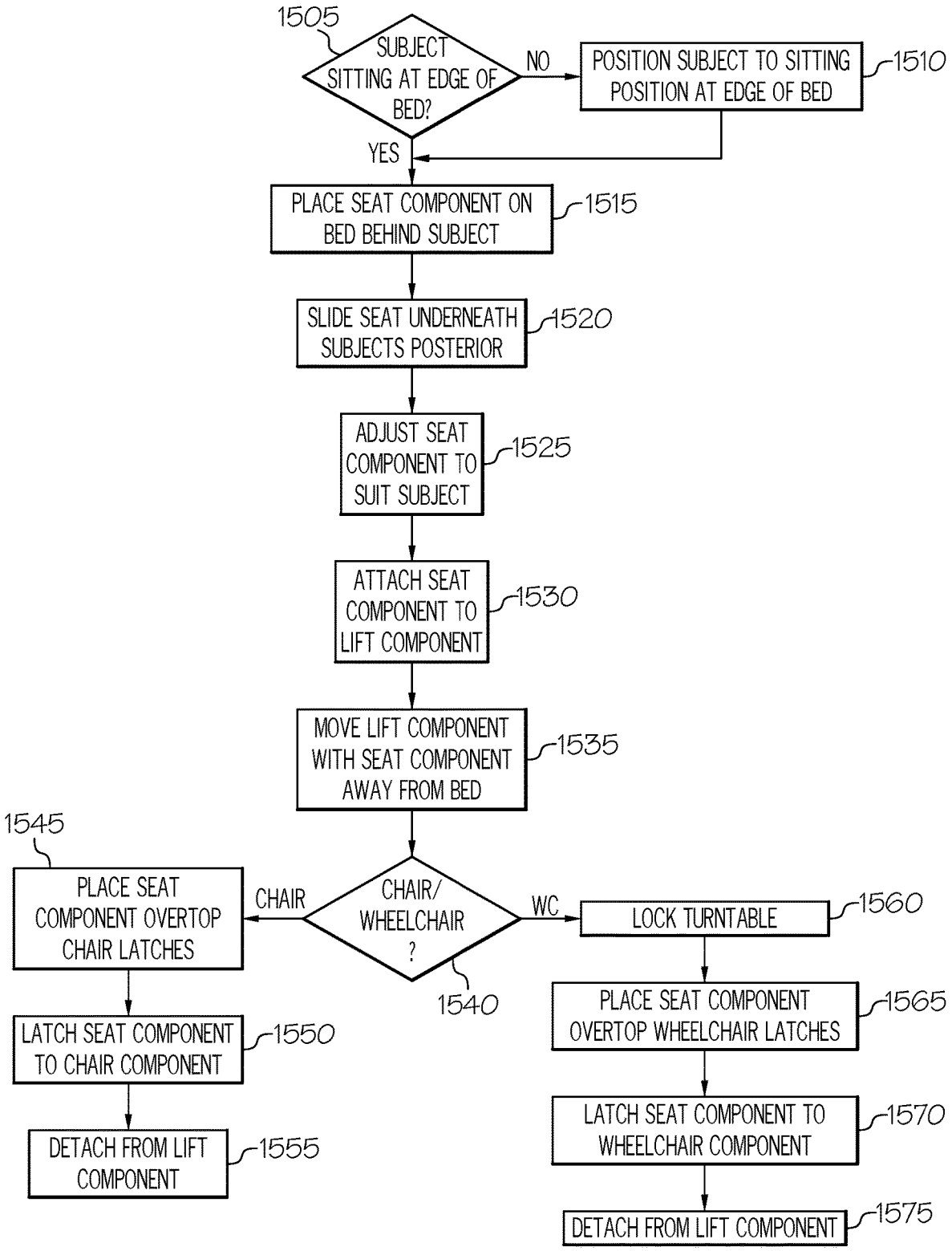
FIG. 15 depicts a flow diagram of an illustrative method of moving a subject using a modular chair system according to one or more embodiments shown and described herein.
Figure 16A:
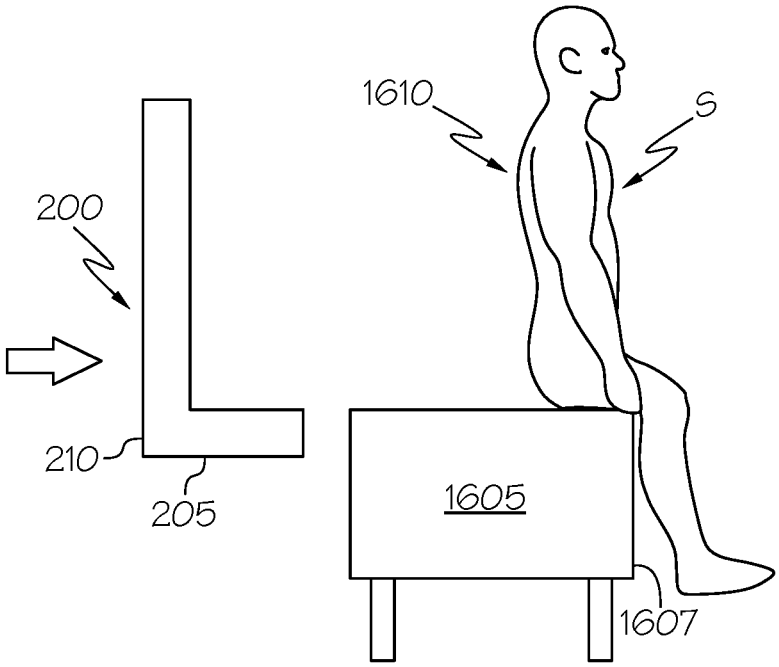
FIG. 16A schematically depicts illustrative movement of a seat component of a modular chair system toward a subject according to one or more embodiments shown and described herein.
Figure 16B:
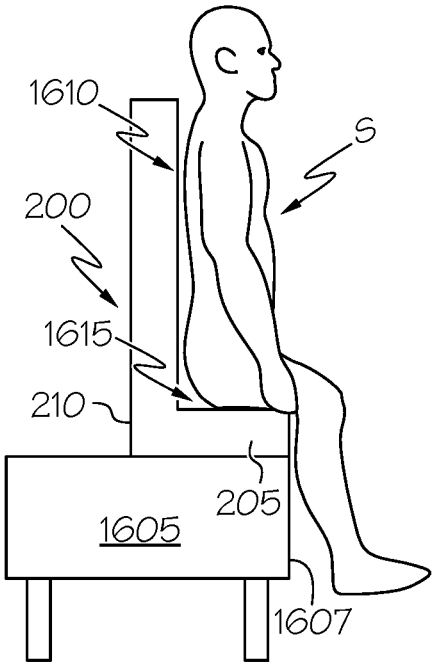
FIG. 16B schematically depicts illustrative placement of a seat component of a modular chair system underneath a posterior of a subject according to one or more embodiments shown and described herein.
Figure 16C:
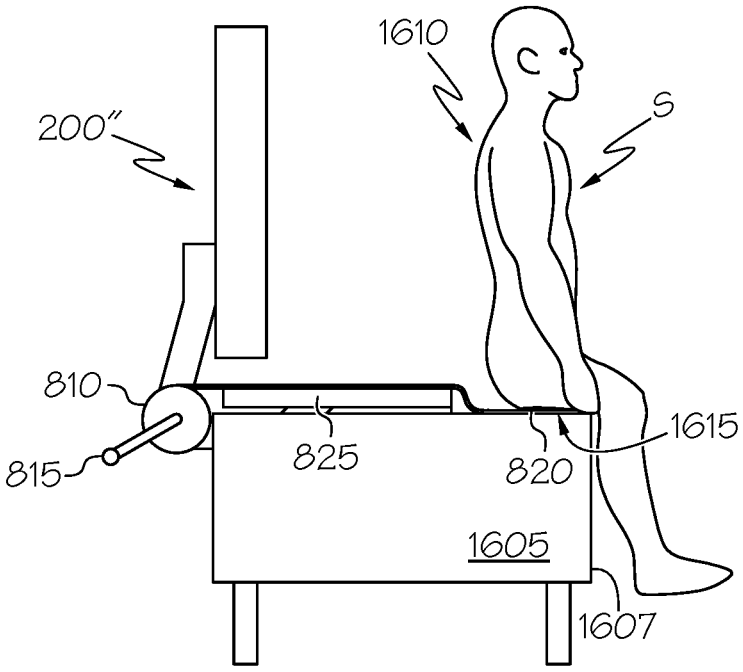
FIG. 16C schematically depicts illustrative movement of another seat component of a modular chair system underneath a posterior of a subject according to one or more embodiments shown and described herein.
Figure 16D:
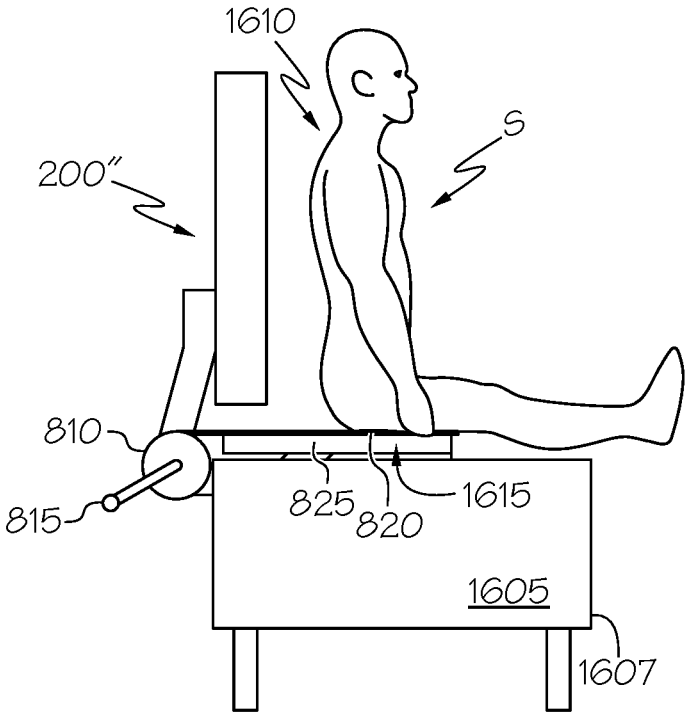
FIG. 16D schematically depicts an illustrative placement of the other seat component depicted in FIG. 16C underneath the posterior of the subject according to one or more embodiments shown and described herein.

Referring to FIGS. 1 and 15, a method of moving a subject using the modular chair system 100 is depicted. At step 1505, a determination may be made as to whether the subject S is sitting at the edge of a bed, such as the subject's personal bed, a hospital bed, or the like. If not, the subject S may be positioned to a sitting position at the edge of the bed at step 1510. It should be understood that step 1510 is optional. That is, in some embodiments, the seat component 200 may be reclined to a flat positioning (i.e., reclined such that the seat 205 and the back 210 are substantially coplanar), positioned underneath the lying subject S, and adjusted with the subject S thereon such that the subject S is moved to a sitting position.

Referring now to FIGS. 1, 15, and 16A-16B, if the subject S is in a seating position on the edge 1607 of the bed 1605, the seat component 200 may be placed behind the subject S at step 1515. At step 1520, the seat 205 is slid underneath the subject's posterior 1615 such that the back 210 contacts the subject's back 1610. Referring also to FIGS. 1, 15, and 16C-16D, it should be understood that steps 1515 and 1520 may alternatively be completed by placing the retractable substrate 820 underneath the subject's posterior 1615 at a location that is distal to the lower support 825 and rotating the reel 810 (e.g., rotating by using the crank 815) such that retractable substrate 820 pulls the subject S onto the lower support 825.

Referring again to FIGS. 1 and 15, the seat component 200 may be adjusted to suit the subject at step 1525. That is, the back 210 may be reclined to a particular positioning that is comfortable for the subject, the arms 215 may be placed and/or adjusted, and/or the like. In some embodiments, step 1525 may further include buckling the subject S to the seat component 200 using one or more of the retention straps and/or adjusting the head support 260 described herein with respect to FIG. 7.

Referring again to FIGS. 1 and 15, at step 1530, the seat component 200 is attached to the lift component 300. That is, the cables 225 may be extended between the lift component 300 and the seat component 200 and coupled thereto. For example, the cables 225 may be pulled out of the locking retraction mechanism 220 and the coupling devices 226 may be clipped onto the corresponding attachment rings 321 (FIG. 5A) or the attachment bars 223 (FIG. 5B) depending on the location of the locking retraction mechanism 220.

Once the seat component 200 is attached to the lift component 300, the lift component 300 is moved away from the bed at step 1535 such that the seat component 200 is suspended by the lift component 300 off the ground. Alternatively, instead of moving the lift component 300, the bed may be moved out from underneath the seat component 200 with the subject S seated therein.

At step 1540, a determination may be made as to whether the subject S is to be placed in the chair component 400 or the wheelchair component 500. If the subject S is to be placed in the chair component 400, the seat component 200 may be placed overtop of the chair component 400 and positioned such that the attachment bars 290 (FIGS. 2A-2B) are aligned with the chair latch mechanisms 415 at step 1545. At step 1550, the seat component 200 is then pressed down in the vertical direction and/or backwards (i.e., in the −y direction of the coordinate axes of FIG. 1) on the chair component 400 to lock the chair latch mechanisms 415 around the attachment bars 290 (FIGS. 2A-2B) to secure the seat component 200 to the chair component 400, as depicted in FIG. 10C.

Still referring to FIGS. 1 and 15, the lift component 300 may be detached from the seat component 200 at step 1555. That is, the cables 225 may be uncoupled from the lift component 300 or the seat component 200. In some embodiments, the cables 225 may further be retracted into the locking retraction mechanism 220 for storage.

If the subject S is to be placed in the wheelchair component 500, the turntable 515 may be locked at step 1560 to ensure it does not rotate during the attachment process described hereinbelow. At step 1565, the seat component 200 may be placed overtop of the wheelchair component 500 and positioned such that the attachment bars 290 (FIGS. 2A-2B) are aligned with the wheelchair latch mechanisms 520. At step 1570, the seat component 200 is then pressed down in the vertical direction and/or backwards (i.e., in the −y direction of the coordinate axes of FIG. 1) on the wheelchair component 500 to lock the wheelchair latch mechanisms 520 around the attachment bars 290 (FIGS. 2A-2B) to secure the seat component 200 to the wheelchair component 500.

Still referring to FIGS. 1 and 15, the lift component 300 may be detached from the seat component 200 at step 1575. That is, the cables 225 may be uncoupled from the lift component 300 or the seat component 200. In some embodiments, the cables 225 may further be retracted into the locking retraction mechanism 220 for storage.

Figure 17:
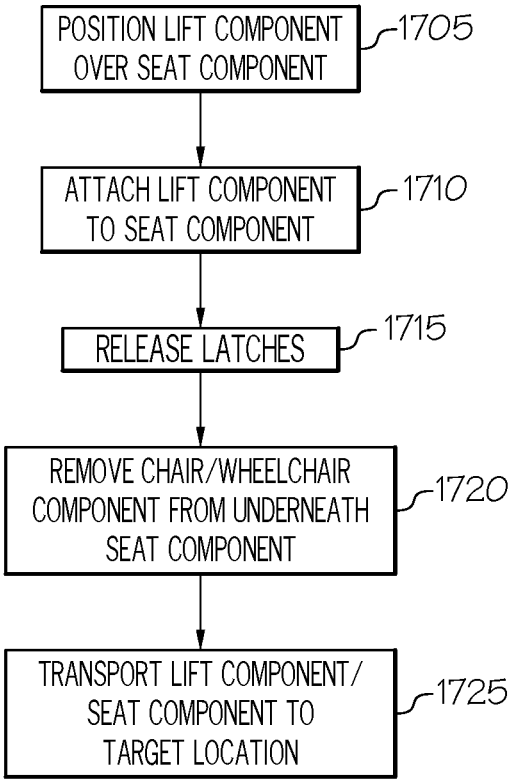
FIG. 17 depicts a flow diagram of an illustrative method of moving a subject away from a chair component or wheelchair component of a modular chair system according to one or more embodiments shown and described herein.

Referring now to FIGS. 1 and 17, a reverse action of detaching the seat component 200 from the component to which it is attached (e.g., the chair component 400 or the wheelchair component 500) is described. At step 1705, the lift component 300 may be positioned over the seat component 200. That is, the lift component 300 may be moved to a location such that the lift component 300 is positioned over the seat component 200 or the chair component 400/wheelchair component 500 holding the seat component 200 may be moved to a location underneath the lift component 300.

At step 1710, the seat component 200 is attached to the lift component 300. That is, the cables 225 may be extended between the lift component 300 and the seat component 200 and coupled thereto. For example, the cables 225 may be pulled out of the locking retraction mechanism 220 and the coupling devices 226 may be clipped onto the corresponding attachment rings 321 (FIG. 5A) or the attachment bars 223 (FIG. 5B) depending on the location of the locking retraction mechanism 220.

Still referring to FIGS. 1 and 17, with the lift component 300 secured to the seat component 200, the chair latch mechanisms 415 on the chair component 400 or the wheelchair latch mechanisms 520 on the wheelchair component 500 may be released at step 1715. That is, the latch release mechanism 420 on the chair component 400 or the latch release mechanism 519 on the wheelchair component 500 may be actuated to open the respective chair latch mechanisms 415/520 so that the attachment bars 290 (FIGS. 2A-2B) are released therefrom.

Still referring to FIGS. 1 and 17, the chair component 400 or the wheelchair component 500 may be removed from underneath the seat component 200 at step 1720 such that the seat component 200 is suspended via the cables 225 from the lift component 300. At step 1725, the lift component 300 holding the seat component 200 may be transported to a target location, such as, for example, the bed or another component (e.g., the chair component 400, the wheelchair component 500, or the like). Alternatively, the target location (e.g., the bed, the chair component 400, the wheelchair component 500, etc.) may be moved underneath the seat component 200 suspending from the lift component 300 without moving the lift component.

Referring now to FIGS. 1 and 17, it may be necessary to rotate the subject S in the wheelchair component 500. For example, if the subject S is to move from the wheelchair component 500 to a vehicle seat, it may be easier upon the subject to rotate the subject S for ease of moving out of the wheelchair component 500.

At step 1805, the wheelchair component 500 with the seat component 200 coupled thereto (and the subject S sitting in the seat component 200) may be moved adjacent to a target location. For example, the wheelchair component 500 may be moved next to a vehicle having an open door. In some embodiments, the wheelchair component 500 may be moved such that the wheelchair component 500 is substantially parallel to the vehicle (i.e., both the vehicle and the wheelchair component 500 are facing the same direction).

At step 1810, the turntable 515 may be unlocked such that the turntable 515 can be pivoted at step 1815. Unlocking the turntable 515 may include, for example depressing the latch release pedal 525 to release the latch 522 holding the attachment bar 535 in the recess 530 of the sidewall 517 of the turntable 515 (FIGS. 13A-13B).

Figure 18:
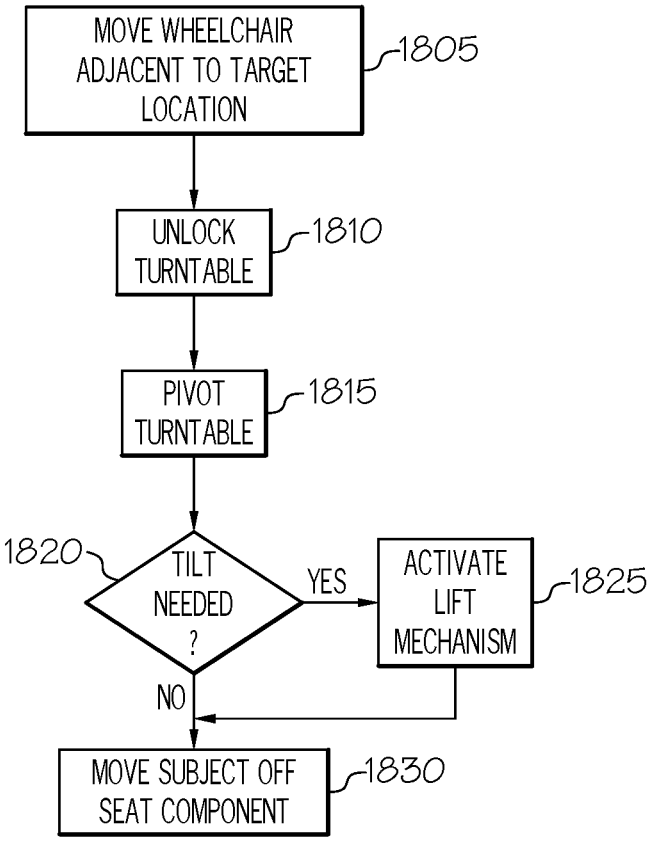
FIG. 18 depicts a flow diagram of an illustrative method of moving a subject away from a wheelchair component of a modular chair system according to one or more embodiments shown and described herein.

Referring to FIGS. 1, 14, and 18, a determination may be made at step 1820 as to whether the seat component 200 needs to be tilted to facilitate movement of the subject S therefrom. If so, the lifting mechanism 550 may be activated at step 1825 to elevate the first end 541 of the support plate 540, which, in turn, elevates an end of the seat component 200 such that the subject S can more easily move off the seat component 200. Accordingly, at step 1830, the subject S may be moved off the seat component 200.

It should now be understood that the modular chair systems described herein are particularly configured such that a subject need only be transferred a single time to move between the bed and the chair component or the wheelchair component. Such a modular chair system can be easily operated by a single operator moving the subject and does not subject the operator to undue strain in moving the subject. That is, a single operator can slide the seat component under the subject, attach the seat component to the lift component, use the lift component to transport the subject to the chair component or the wheelchair component, and secure the seat component to the chair component or wheelchair component.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A modular chair system comprising:

a seat component comprising a surface with one or more recesses and one or more attachment bars disposed within each of the one or more recesses;

a chair component comprising one or more chair latch mechanisms; and a wheelchair component comprising one or more wheelchair latch mechanisms, wherein each one of the one or more attachment bars corresponds to one of the one or more chair latch mechanisms and one of the one or more wheelchair latch mechanisms such that the seat component is configured to be placed upon the chair component or the wheelchair component and releasably held in place by the one or more chair latch mechanisms or the one or more wheelchair latch mechanisms.

2. The modular chair system of claim 1, further comprising a lift component comprising a plurality of attachment points, wherein the lift component is configured to support the seat component at one or more of the plurality of attachment points.

3. The modular chair system of claim 2, wherein:

the seat component further comprises a plurality of cables; and the plurality of cables are attachable to the plurality of attachment points.

4. The modular chair system of claim 2, wherein the lift component further comprises a plurality of locking retraction mechanisms disposed at the plurality of attachment points, each one of the locking retraction mechanisms holding a cable that is attachable to the seat component.

5. The modular chair system of claim 1, wherein:

the seat component further comprises a back coupled to a seat, the back comprising one or more attachment bars; and each one of the one or more attachment bars on the back of the seat component corresponds to one of the one or more chair latch mechanisms and one of the one or more wheelchair latch mechanisms such that the back of the seat component is releasably held in place by the one or more chair latch mechanisms or the one or more wheelchair latch mechanisms when the seat component is placed on the chair component or the wheelchair component.

6. The modular chair system of claim 1, wherein:

the seat component further comprises a back coupled to a seat via one or more hinges; and the back is pivotable relative to the seat such that the seat component reclines.

7. The modular chair system of claim 1, wherein:

the wheelchair component further comprises a wheelchair frame having an upper frame member coupled to a lower frame member;

the lower frame member comprises a support plate disposed on the lower frame member; and the one or more chair latch mechanisms are disposed on the support plate.

8. The modular chair system of claim 1, wherein:

the wheelchair component further comprises a wheelchair frame having an upper frame member coupled to a lower frame member;

the lower frame member comprises a support plate disposed on the lower frame member;

the support plate comprises a turntable rotatably mounted to the support plate; and the one or more wheelchair latch mechanisms are disposed on the turntable.

9. The modular chair system of claim 8, wherein the turntable is lockable via a latch such that, when locked, the turntable does not rotate.

10. The modular chair system of claim 1, wherein the wheelchair component further comprises a latch release mechanism configured to control an opening and a closing of the one or more wheelchair latch mechanisms.

11. The modular chair system of claim 1, wherein the seat component further comprises:

a back;

a seat coupled to the back, the surface being a planar lower surface of the seat, wherein the planar lower surface comprises the one or more recesses; and a plurality of cables extending from the seat and the back, wherein the plurality of cables are configured to be releasably coupled to a lift component to suspend the seat component from the lift component.

12. The modular chair system of claim 11, wherein the seat component further comprises a plurality of locking retraction mechanisms disposed on the seat, each one of the plurality of locking retraction mechanisms holding one of the plurality of cables.

13. The modular chair system of claim 11, wherein the seat component further comprises one or more retention straps.

14. The modular chair system of claim 11, wherein the seat component further comprises a head support.

15. The modular chair system of claim 1, wherein the seat component further comprises:

a back;

a lower support coupled to the back via a coupling frame;

a retractable substrate disposed on the lower support; and a reel coupled to the coupling frame, wherein the retractable substrate is at least partially wound around the reel.

16. The modular chair system of claim 15, wherein the retractable substrate comprises a first surface having a frictional coating.

17. A modular chair system comprising:

a seat component comprising a surface with one or more recesses and one or more attachment bars disposed within each of the one or more recesses; and an accessory component comprising one or more latch mechanisms, wherein each one of the one or more attachment bars corresponds to one of the one or more latch mechanisms such that the seat component is configured to be placed upon the accessory component and releasably held in place by the one or more latch mechanisms.

18. A method of transporting a subject via a modular chair system comprising a seat component having a surface with one or more recesses and one or more attachment bars disposed within each of the one or more recesses, and an accessory component having a plurality of latch mechanisms, the method comprising:

positioning the seat component underneath the subject, wherein the subject is sitting or lying on a bed;

transporting the seat component with the subject thereon to the accessory component;

aligning each of the attachment bars with a corresponding one of the latch mechanisms; and coupling the seat component to the accessory component by securing the plurality of attachment bars to the plurality of latch mechanisms.

19. The method of claim 18, wherein the modular chair system further comprises a lift component, and wherein transporting the seat component comprises:

coupling the seat component to the lift component via a plurality of cables extending between the seat component and the lift component such that the seat component is suspended from the lift component;

transporting the lift component and the seat component to the accessory component; and after coupling the seat component to the accessory component, disconnecting the plurality of cables from one or more of the seat component and the lift component.

20. The method of claim 19, further comprising:

positioning the lift component over the seat component;

connecting the plurality of cables between the lift component and the seat component;

releasing the plurality of latch mechanisms;

removing the accessory component from underneath the seat component; and moving the lift component and the seat component to a target location.

* * * * *